US006935124B2

(12) United States Patent
Takahashi et al.

(10) Patent No.: US 6,935,124 B2
(45) Date of Patent: Aug. 30, 2005

(54) CLEAR ICE MAKING APPARATUS, CLEAR ICE MAKING METHOD AND REFRIGERATOR

(75) Inventors: Yasuhito Takahashi, Osaka (JP); Katutosi Tusima, Toyama (JP); Takumi Kida, Nara (JP); Yuko Ishii, Hyogo (JP); Hiroshi Tatsui, Shiga (JP); Kazuyuki Hamada, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/447,878

(22) Filed: May 29, 2003

(65) Prior Publication Data

US 2004/0025527 A1 Feb. 12, 2004

(30) Foreign Application Priority Data

May 30, 2002 (JP) ..... 2002-157039
May 31, 2002 (JP) ..... 2002-160346
May 31, 2002 (JP) ..... 2002-160347
Jul. 24, 2002 (JP) ..... 2002-215713

(51) Int. Cl.[7] ..... F25C 1/12
(52) U.S. Cl. ..... 62/74; 62/347
(58) Field of Search ..... 62/66, 68, 340, 62/356

(56) References Cited

U.S. PATENT DOCUMENTS 1,322,660 A * 11/1919 Voorhees ..... 62/64
1,943,466 A * 1/1934 West et al. ..... 62/66
2,498,645 A * 2/1950 Bobby ..... 62/75
3,224,213 A * 12/1965 Hoyt, Jr. ..... 62/68
3,318,105 A * 5/1967 Burroughs et al. ..... 62/71
3,321,932 A * 5/1967 Orphey, Jr. ..... 62/340
3,775,992 A 12/1973 Bright
4,550,575 A * 11/1985 DeGaynor ..... 62/308
4,620,422 A * 11/1986 Hosokawa et al. ..... 62/70
5,076,069 A * 12/1991 Brown ..... 62/308

FOREIGN PATENT DOCUMENTS

JP 01-181047 7/1989
JP 2001-041623 2/2001
JP 2001-041624 2/2001

OTHER PUBLICATIONS

European Search Report corresponding to application No. EP 03–01–2435 dated Jan. 4, 2005.

* cited by examiner

*Primary Examiner*—William E. Tapolcai
(74) *Attorney, Agent, or Firm*—RatnerPrestia

(57) ABSTRACT

A clear ice making apparatus includes: a freezing space; a tray placed in the freezing space and having a lower temperature at a bottom part thereof than at an upper part thereof; and a water supply unit of supplying water to the tray from the top thereof, in which ice is made at an ice making rate of 5 $\mu$m/s or lower, a part of a liquid-phase section of water in the tray which part is in contact with atmosphere is frozen to complete the ice making, the liquid-phase section of water is not entirely supercooled before the ice making is completed, and the concentration of air in the liquid-phase section of water in the tray is equal to or lower than an excessive concentration of air.

7 Claims, 22 Drawing Sheets

CLEAR ICE MAKING APPARATUS, CLEAR ICE MAKING METHOD AND REFRIGERATOR

BACKGROUND OF THE INVENTION

1. Field of the Invention

The present invention relates to a clear ice making apparatus and a clear ice making method for making a clear ice in a household refrigerator.

2. Related Art of the Invention

In conventional household refrigerators, to make a clear ice, an ice making tray is vibrated once water is poured into it, thereby preventing air bubbles produced during freezing from remaining in the resulting ice, or water having a dissolved gas such as air previously removed therefrom is used.

Alternatively, once water has poured into an ice making tray, the upper part of the ice making tray is heated to develop a temperature difference between the upper and lower parts of the ice making tray, thereby preventing air bubbles produced during freezing from remaining in the resulting ice.

Alternatively, in addition to avoiding air bubbles, to prevent hard ions such as calcium ions from being deposited in the resulting ice and thus making the ice cloudy, industrial refrigerators adopt a process in which an ice making tray in which water is to be frozen is set face down and water is supplied in the shape of a fountain into it, thereby gradually producing an ice on the side face of the ice making tray.

Alternatively, there is a process of producing a single crystal ice which is modeled on the process of production of a natural ice stalagmitic.

A large problem about making a clear ice is how to prevent air bubbles produced during freezing from being trapped in the resulting ice. Another problem is how to prevent hard ions contained in highly hard well water or mineral water in themselves from being deposited or air bubbles from being produced by impurities such as hard ions becoming cores thereof.

Specifically, general tap water contains about 15–30 ppm of hard ions and about 20 ppm of a dissolved gas. When freezing water, whether the resulting ice is clear or cloudy depends upon a combination of an interface shift rate of the solid-liquid interface between the ice and water (a rate of crystallization of water) and a diffusion rate of impurities ejected from the crystal (a rate of ejection of impurities from the ice). Therefore, in order to make a clear ice, it is essential to make an ice as slowly as possible, and thus, there is a problem in that the time required to make an ice cannot be shortened even if it is desired.

In particular, when the ice is cloudy because of dissolved air, diffusion of air in water is significantly involved. If the shift rate of the interface between the ice and water is high, the dissolved air remains in the ice. However, if the interface shift rate is low, molecules of air excluded from the ice are accumulated in water near the interface, thereby forming a region containing an excessive concentration of molecules of air. Such excessive molecules of air increase as the ice grows, and then, when the amount thereof go beyond a certain limit, the molecules form a macroscopic air bubble, which is eventually trapped in the growing ice.

In addition, the rate of ice making is also reduced by the temperature at the solid-liquid interface being increased by latent heat generated when a liquid phase changes into a solid phase at the static solid-liquid interface.

Even in the case where water is poured into an ice making tray at once, and the ice making tray is vibrated to prevent air bubbles from remaining in the resulting ice, when a large amount of water is frozen at once, the amounts of dissolved gas and hard ions contained in the water are large. Thus, the hard ions may be accumulated in the surface of the resulting ice to make the ice cloudy.

In the case of making an ice based on the principle of production of a natural ice stalagmitic, a single crystal ice of extremely high quality can be made. However, there is a problem in that the rate of ice making is extremely low, and it takes several days to make an ice.

Furthermore, the process of setting an opening of the ice making tray face down and suppling in the shape of a fountain into it involves a bulky apparatus and thus, is hot suitable for household application.

The process of physically vibrating the ice making tray to prevent air bubbles produced during crystallization of water from remaining in the resulting ice, a certain degree of transparency can be achieved. However, in the case where the air bubbles produced are small, there is a problem in that the bubbles are not separated from the interface between the ice and water and are trapped in the ice.

The process of removing a gas from water before crystallization is effective in making a clear ice. However, it involves a large-scale arrangement, resulting in a significant increase of cost. Furthermore, it has a problem in that if ice making takes a long time, air is dissolved again in the degassed water, air bubbles are produced during crystallization, and thus, an ice with a high transparency cannot be obtained.

Furthermore, there is a process of making a single crystal ice with a high transparency by dropping water droplets on a plane surface without a tray. However, the process has a problem in that, for the household and industrial refrigerators, it is required to make ices in a tray, and thus, an ice similar to the natural ice stalagmitic cannot be made.

As described above, conventional ice making apparatus have a problem in that it is difficult to make an ice with a high transparency.

SUMMARY OF THE INVENTION

The $1^{st}$ aspect of the present invention is a clear ice making apparatus, comprising:

a freezing space;

a tray placed in said freezing space and having a lower temperature at a bottom part thereof than at an upper part thereof; and water supply means of supplying water to said tray, wherein an ice is made at an ice making rate of 5 $\mu$m/s or lower, a part of a liquid-phase section of water in said tray which part is in contact with atmosphere remains in a liquid phase until the ice making is completed, and the liquid-phase section of water in said tray has a thickness equal to or less than a predetermined thickness.

The $2^{nd}$ aspect of the present invention is the clear ice making apparatus according to the $1^{st}$ aspect, wherein said predetermined thickness is a thickness that allows substantially no air bubble to be generated.

The $3^{rd}$ aspect of the present invention is the clear ice making apparatus according to the $1^{st}$ or $2^{nd}$ aspect, wherein said ice making rate is equal to or higher than 2 $\mu$m/s.

The $4^{th}$ aspect of the present invention is the clear ice making apparatus according to any of the $1^{st}$ to $3^{rd}$ aspects, wherein said water supply means supplies water intermittently from a top of said tray.

The $5^{th}$ aspect of the present invention is the clear ice making apparatus according to the $4^{th}$ aspect, wherein said water supply means starts a following supply of water before a surface of the water having already been supplied is frozen and repeats such supply of water until the ice being made attains a predetermined thickness, and when the supply of water is stopped, the part of the liquid-phase section of water in said tray which part is in contact with atmosphere is lastly frozen.

The $6^{th}$ aspect of the present invention is the clear ice making apparatus according to the $4^{th}$ or $5^{th}$ aspect, wherein the interval at which said water supply means supplies water is adapted to prevent the entire liquid-phase section of water in said tray from being supercooled.

The $7^{th}$ aspect of the present invention is the clear ice making apparatus according to any of the $1^{st}$ to $6^{th}$ aspects, wherein the temperature of a side surface of said tray is higher than that of the bottom surface thereof.

The $8^{th}$ aspect of the present invention is a clear ice making method of making a clear ice using a clear ice making apparatus, the clear ice making apparatus comprising a freezing space, a tray placed in said freezing space and having a lower temperature at a bottom part thereof than at an upper part thereof, and water supply means of supplying water to said tray, wherein an ice is made at an ice making rate of 5 $\mu$m/s or lower, a part of a liquid-phase section of water in said tray which part is in contact with atmosphere remains in a liquid phase until the ice making is completed, and the liquid-phase section of water in said tray has a thickness equal to or less than a predetermined thickness.

The $9^{th}$ aspect of the present invention is a clear ice making apparatus comprising:

a tray placed in a freezing space having a door capable of being opened and closed, the tray being kept at a higher temperature at an upper part thereof and at a lower temperature at a bottom part thereof and having an opening at a top thereof; and a water supply system of intermittently supplying water to said tray through the opening thereof, wherein said water supply system has a feed water tank disposed in a space kept at a temperature lower than a room temperature and a pump used for supplying water from said feed water tank to a water feed nozzle through a water feed pipe, and a tip of said water feed nozzle protrudes into said opening of said tray.

The $10^{th}$ aspect of the present invention is the clear ice making apparatus according to the $9^{th}$ aspect, further comprising:

temperature detecting means of detecting a temperature of the bottom part of said tray; and control means of controlling the water supply interval and the amount of supply water in accordance with the temperature of the bottom part of said tray, the control means being adapted to start supply of water when the temperature of the bottom part of said tray becomes lower than a first predetermined temperature.

The $11^{th}$ aspect of the present invention is the clear ice making apparatus according to the $9^{th}$ aspect, wherein the tip of said water feed nozzle is treated to be hydrophilic.

The $12^{th}$ aspect of the present invention is the clear ice making apparatus according to the $9^{th}$ aspect, further comprising door open/close detecting means of detecting whether said door is opened or closed and timer means of counting the time during which said door is opened, wherein the water supply interval is changed during a predetermined time based on signals received from said door open/close detecting means and said timer means.

The $13^{th}$ aspect of the present invention is the clear ice making apparatus according to the $9^{th}$ aspect, further comprising ice making starting means.

The $14^{th}$ aspect of the present invention is a clear ice making apparatus, where in a space A kept at a temperature higher than 0° C. is located above and adjacent to a space B kept at a temperature lower than 0° C. and separated therefrom by a cooling plate, a water feed nozzle for supplying water to an ice making tray on said cooling plate is disposed in said space A, and an ice is made by intermittently supplying water to said ice making tray.

The $15^{th}$ aspect of the present invention is a refrigerator comprising a clear ice making apparatus according to the $14^{th}$ aspect and a refrigerating room, wherein said refrigerating room is located above said space A, said ice making tray and said water feed nozzle are disposed in a metal tray, and in a region which separates said space A and said refrigerating room, a window is provided to let the temperature of the outside of said metal tray be substantially the same as that in said refrigerating room.

The $16^{th}$ aspect of the present invention is a refrigerator comprising a clear ice making apparatus according to the $14^{th}$ aspect and a refrigerating room, further comprising:

temperature detecting means provided at the bottom part and the upper part of said ice making tray; and control means that starts intermittent water supply when the temperature of the bottom part of said ice making tray becomes lower than a predetermined value, stops the water supply after a lapse of a predetermined time, and starts releasing the ice from the ice making tray when the temperature of the upper part of said ice making tray becomes lower than a predetermined value.

The $17^{th}$ aspect of the present invention is the refrigerator according to the $15^{th}$ aspect, wherein a feed water tank is disposed in said refrigerating room, and said supply of water is conducted by means of a water feed pump.

The $18^{th}$ aspect of the present invention is the refrigerator according to the $15^{th}$ aspect, wherein a feed water tank is disposed in said refrigerating room, a vacuum pump is provided for evacuating the air in said metal tray, a solenoid valve is provided at a predetermined position between said feed water tank and said water feed nozzle, and said solenoid valve is switched between on and off states to intermittently supply water into said ice making tray for making an ice.

The $19^{th}$ aspect of the present invention is the refrigerator according to the $18^{th}$ aspect, wherein said cooling plate is capable of being opened and closed, temperature detecting means are provided at the bottom part and the upper part of said ice making tray, open/close detecting means that detects whether the cooling plate is opened or closed is provided, and control means closes said solenoid valve and starts evacuation when said cooling plate is closed, switches on said solenoid valve to supply water when the temperature of the bottom part of said ice making tray becomes lower than a predetermined value, maintains the on state for a predetermined time, switches off the solenoid valve to stop supply of water after a lapse of the predetermined time, repeats such switching on and off to intermittently supply water, stops such intermittent supply of water after a lapse of a predetermined time, and stops evacuation when the temperature of the upper part of said ice making tray becomes lower than a predetermined value to start releasing of the ice from the ice making tray.

The $20^{th}$ aspect of the present invention is the refrigerator according to any of the $15^{th}$ to $19^{th}$ aspects, wherein a cold air outlet is provided to each of said spaces A and B.

The $21^{st}$ aspect of the present invention is a clear ice making apparatus comprising:

an ice making tray placed in a space which is cooled to a freezing point and having a recess opened upward;

a water feed nozzle of feeding water to the recess;

reciprocating means of reciprocating said ice making tray during ice making; and intermittent water supply means of supplying an amount of water required for ice making in said recess dividedly and intermittently plural times from said water feed nozzle, wherein a temperature of an upper part of said ice making tray is maintained substantially at 0° C.

The $22^{nd}$ aspect of the present invention is the clear ice making apparatus according to the $21^{st}$ aspect, further comprising:

first temperature detecting means of detecting the temperature of the upper part of the recess of said ice making tray;

second temperature detecting means of detecting the temperature of the bottom part of said recess; and control means of controlling said intermittent water supply means and said reciprocating means based on the temperature detected by said first or second temperature detecting means.

The $23^{rd}$ aspect of the present invention is the clear ice making apparatus according to the $21^{st}$ or $22^{nd}$ aspect, further comprising heating means of heating the upper part of the recess of said ice making tray during ice making.

The $24^{th}$ aspect of the present invention is the clear ice making apparatus according to the $23^{rd}$ aspect, wherein said control means controls said intermittent water supply means, said reciprocating means and said heating means based on the temperature detected by said first or second temperature detecting means.

The $25^{th}$ aspect of the present invention is a clear ice making apparatus, comprising:

an ice making tray placed in a space which is cooled to a freezing point and having a recess opened upward;

heating means of heating an upper part of the recess of said ice making tray during ice making;

first temperature detecting means of detecting the temperature of the upper part of the recesses of said ice making tray;

second temperature detecting means of detecting the temperature of the bottom part of said recess; and control means that compares the temperatures detected by said first and second temperature detecting means with first and second predetermined temperatures, starts intermittent water supply from an opening of said tray and reciprocation of said tray when said first detected temperature is equal to or higher than said first predetermined temperature and said second detected temperature is equal to or lower than said second predetermined temperature, stops the intermittent water supply and the reciprocation and heating of the tray after a lapse of a predetermined time, determines that the ice making is completed when the temperature detected by said first temperature detecting means is equal to or lower than a third predetermined temperature to start releasing of the ice from the ice making tray, and starts heating by said heating means again after the ice is completely released.

The $26^{th}$ aspect of the present invention is a clear ice making apparatus, comprising:

an ice making tray placed in a space which is cooled to a freezing point and having a recess opened upward;

heating means of heating an upper part of the recess of said ice making tray during ice making;

first temperature detecting means of detecting the temperature of the upper part of the recess of said ice making tray;

second temperature detecting means of detecting the temperature of the bottom part of said recess; and control means that compares the temperatures detected by said first and second temperature detecting means with first and second predetermined temperatures, starts intermittent water supply from an opening of said tray and reciprocation of said tray when said first detected temperature is equal to or higher than said first predetermined temperature and said second detected temperature is equal to or lower than said second predetermined temperature, stops heating when the amount of water having been supplied reaches a predetermined amount, stops the intermittent water supply and the reciprocation of the tray after a lapse of a predetermined time from the start of said intermittent water supply and reciprocation of the tray, determines that the ice making is completed when the temperature detected by said first temperature detecting means is equal to or lower than a third predetermined temperature to start releasing of the ice from the ice making tray, and starts heating by said heating means again after the ice is completely released.

The $27^{th}$ aspect of the present invention is a clear ice making apparatus, comprising:

an ice making tray placed in a space which is cooled to a freezing point and having a recess opened upward;

heating means of heating the upper part of the recess of said ice making tray during ice making;

first temperature detecting means of detecting the temperature of an upper part of the recess of said ice making tray;

second temperature detecting means of detecting the temperature of the bottom part of said recess; and control means that compares the temperatures detected by said first and second temperature detecting means with first and second predetermined temperatures, starts intermittent water supply from an opening of said tray and reciprocation of said tray when said first detected temperature is equal to or higher than said first predetermined temperature and said second detected temperature is equal to or lower than said second predetermined temperature, controls heating by said heating means in accordance with the amount of water having been supplied, stops the intermittent water supply and the reciprocation of the tray after a lapse of a predetermined time, determines that the ice making is completed when the temperature detected by said first temperature detecting means is equal to or lower than a third predetermined temperature to start releasing of the ice from the ice making tray, and starts heating by said heating means again after the ice is completely released.

The $28^{th}$ aspect of the present invention is the clear ice making apparatus according to any of the $21^{st}$ to $23^{rd}$ aspects, wherein said heating means is a heater wire coated with an insulating film and further covered with a material with a high heat conductivity.

The $29^{th}$ aspect of the present invention is the clear ice making apparatus according to any of the $21^{st}$ to $23^{rd}$ aspects, wherein the reciprocation of said ice making tray is translation thereof.

The 30$^{th}$ aspect of the present invention is the clear ice making apparatus according to any of the 21$^{st}$ to 23$^{rd}$ aspects, wherein the reciprocation of said ice making tray is pivotal movement thereof over a predetermined rotation angle about a middle point in a shorter side of the tray.

DESIGNATION OF REFERENCE NUMERALS

Figure 1:
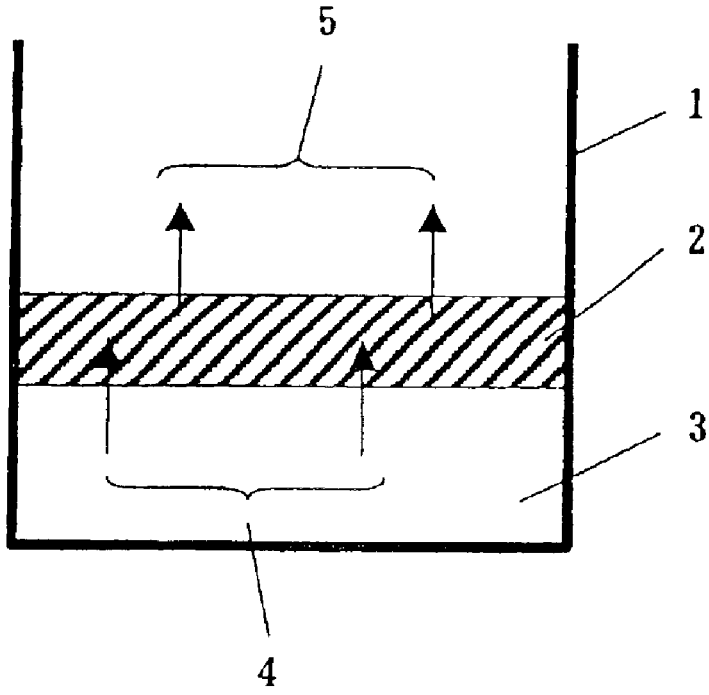
FIG. 1 is a cross sectional view illustrating ice making in an ice making tray according to an embodiment of the invention.

1 Ice making tray
2 Water
3 Ice
4 Dissolved air forced out of ice
5 Dissolved air emitted to atmosphere
41 Direction of diffusion of impurities
101 Ice making tray
102 Freezing compartment
105 Door
106 Feed water tank
108 Water feed pump
109 Water feed pipe
110 Water feed nozzle
111 Heat insulating material
126 Ice making start button
131 Heater
151 Temperature sensor
201 Ice making room
202 Cooling plate
203 Ice making tray
205 Water feed nozzle
206 Feed water tank
207 Refrigerating room
208 Ice storage compartment
209 Packing
211 Heat insulating material
212 Air vent
213 Water feed pump
214 Metal tray
219, 220 Thermistor
231 Solenoid valve
232 Vacuum pump
301 Ice making tray
303 Cooling plate
307 Actuator
308 Heater
309 Water feed nozzle
311 Water feed pump
312 Feed water tank
315, 316 Thermistor
331 Rotation shaft

PREFERRED EMBODIMENTS OF THE INVENTION

In the following, embodiments of the invention and operations thereof will be described with reference to the drawings.

(Embodiment 1)

In conventional ice making processes, a significant consideration is how to prevent hard ions or dissolved air in tap or well water from remaining in the resulting ice in order to make the ice clear. According to this embodiment, a clear ice is made by preventing dissolved air (about 40 ppm at a temperature of 0° C. and under a pressure of 1 atmosphere) from remaining in the resulting ice and preventing an air bubble core from being generated in the liquid layer to attain efficient degassing, and by trapping, rather than removing, impurities including hard ions in the resulting ice such as in a grain boundary.

First, a mechanism for efficiently suppressing generation of an air bubble by intermittently supplying water from water supply means (not shown) will be described.

Referring to FIG. 1, part of water in an ice making tray 1 is frozen into an ice 3 and the rest remains as water 2. Although not shown in FIG. 1, in order to keep the bottom part of the ice making tray 1 at a lower temperature, more cold air is blown thereto, or a cooling plate is disposed. In addition, in order to keep the upper part of the ice making tray 1 at a higher temperature, a heater or heat insulator is disposed. In this way, the temperature of the bottom part of the ice making tray 1 is set at −10° C., and the temperature of the upper part thereof is set at 0° C., for example. And, the water supply means intermittently supplies water into the ice making tray 1 from the top thereof. When the ice 3 is made attains a predetermined thickness and the water supply means stop supplying water, the part of the liquid-phase section of water 2 in tray 1 which part is in contact with atmosphere is frozen lastly, since such temperature gradient is provided.

An extremely high ice making rate results in generation of an air bubble at the solid-liquid interface between the ice and water, which causes the resulting ice to be cloudy. If the ice making rate is equal to or lower than 5 μm/s, dissolved air 4, which has been forced into water without being trapped in the ice 3, forms no air bubble and is dissolved in water 3, and then is ejected to the atmosphere.

Figure 2:
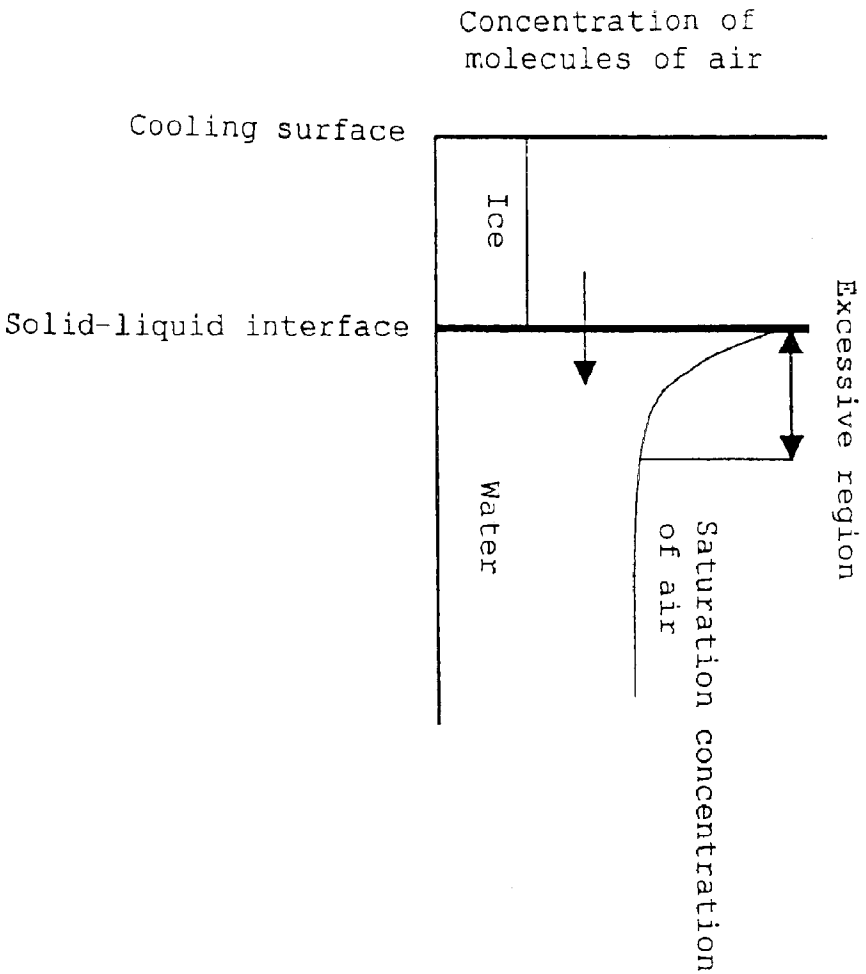
FIG. 2 is a graph showing a change of concentration of molecules of air according to an embodiment of the invention.

As shown in FIG. 2, molecules of air forced out of the ice are not immediately diffused throughout the liquid layer, and a region which contains an excessive amount of molecules of air is formed at the solid-liquid interface on the side of water. If the ice making rate is high, the excessive molecules of dissolved air in that region go beyond a limit concentration to form an air bubble core, and molecules of air in the vicinity of the core flows into it, thereby quickly forming an air bubble. However, if the freezing rate is equal to or lower than 5 μm/s, the excessive molecules of air in the region are kept at or below the limit concentration, and thus, no air bubble is produced.

In the following, the reason why no air bubble core is produced will be described. Provided that, in the region containing excessive molecules of air, the molecules of dissolved air congregate to form a small air bubble core having a diameter of b for some reason. At the moment of production of an air bubble, an interface is formed between the air bubble and water, initial molecules of air release internal energy to rapidly expand, and the air bubble internal pressure P is reduced to a level at which a balance is attained between the air bubble internal pressure and a hydrostatic pressure plus a surface tension. Thus, the following formula 1 holds:

$$P=P_0+\Lambda \quad \text{(formula 1)},$$

where $P_0$ denotes a hydrostatic pressure (atmospheric pressure+weight of water≦1 atmosphere), and $\Lambda=4\gamma/b$ (γ: surface tension, 71 dyn/cm).

Provided that, immediately after the air bubble core having a diameter of b and a surface area of s is formed, a trace amount of, δn mol of, molecules of air additionally flows into the core from the periphery, so that the number of molecules of air increases by δn mol with the air bubble internal pressure being kept at P, and accordingly, the air bubble diameter increases by δb. In this case, a variation δG of energy of the system can be determined as follows.

That is, a quantity of energy released from inflow molecules of air and an increase of surface energy of water are expressed by the following formulas 2:

$$\text{(quantity of energy released from inflow molecules of air)}=-(\delta n)RT\{\ln(\phi/P)\} \quad \text{(formula 2); and}$$

$$\text{(increase of surface energy of water)}=(\delta s)\gamma \quad \text{(formula 2)}.$$

The equation of state in the air bubble is PV=nRT, the volume of the air bubble is expressed as V=πb/6, and the surface area of the air bubble is expressed as s=πb. Variations thereof are expressed by the following formulas 3:

$$\delta n=(\delta V)P/RT=(\delta b)\pi bP/2RT \quad \text{(formula 3); and}$$

$$\delta s=2\pi b(\delta b) \quad \text{(formula 3)}.$$

Therefore, the variation δG of energy of the system is expressed by the following formulas 4:

$$\delta G=-(\delta b)\pi(b/2)PIn(\phi/P)+2\pi b\gamma(\delta b) \quad \text{(formula 4); and}$$

$$\delta G/\delta b=\pi(b/2)[-PIn(\phi/P)+4\gamma/b] \quad \text{(formula 4)}.$$

For the air bubble to grow, the energy needs to decrease as the air bubble diameter increases. That is, it is required that the following formula 5 holds:

$$\delta G/\delta b\leqq 0 \quad \text{(formula 5)}.$$

Thus, the following formula 6 holds:

$$PIn(\phi/P)\geqq 4\gamma/b=\Lambda \quad \text{(formula 6)}.$$

The minimum pressure φmin in the air bubble is expressed by the following formula 7:

$$\phi\min=P\exp[\Lambda/P] \quad \text{(formula 7)}.$$

Figure 3:
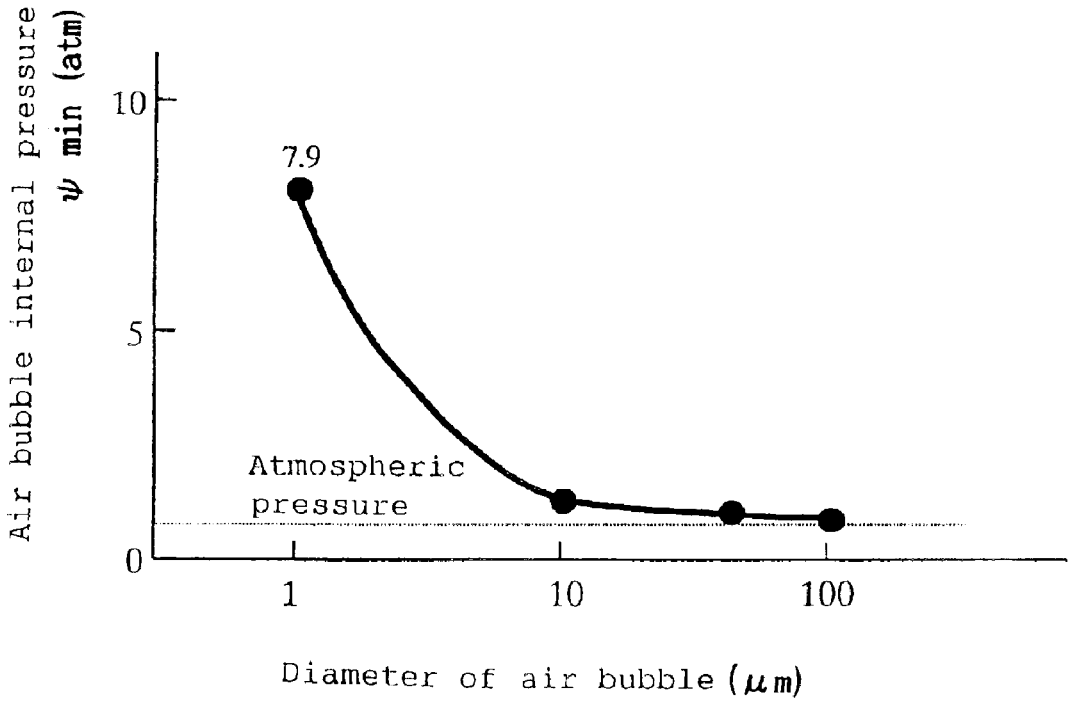
FIG. 3 is a graph showing a relationship between a diameter of an air bubble and a pressure in the air bubble according to an embodiment of the invention.

FIG. 3 shows a relationship between the air bubble diameter b and the air bubble internal pressure φmin. As can be seen from FIG. 3, in order for an air bubble having a diameter of about 1 μm to occur for some cause (dissolved silica, hard ions or the like), the excessive molecules of air are required to exist in an amount enough to provide an air bubble internal pressure of about 7.9 atmosphere.

In other words, the concentration of the molecules of air needs to be about eight times as high as the saturation concentration of molecules of air (about 1 atmosphere). However, once an air bubble core is generated, the molecules of air flow into the air bubble core to rapidly decrease the air bubble internal pressure, whereby a stable air bubble exists in the liquid layer.

Therefore, in order to prevent the resulting ice from being cloudy because of air bubbles, it is preferred that the ice making rate is as low as possible. However, if the ice making rate is too low, there arises a problem in that ices cannot be obtained in an adequate amount when required, for example, in summer. An investigation has proved that when the ice making rate is set at 2–5 μm/s, a clear ice having a volume of 10 ml can be made in 1–2 hours.

Figure 6:
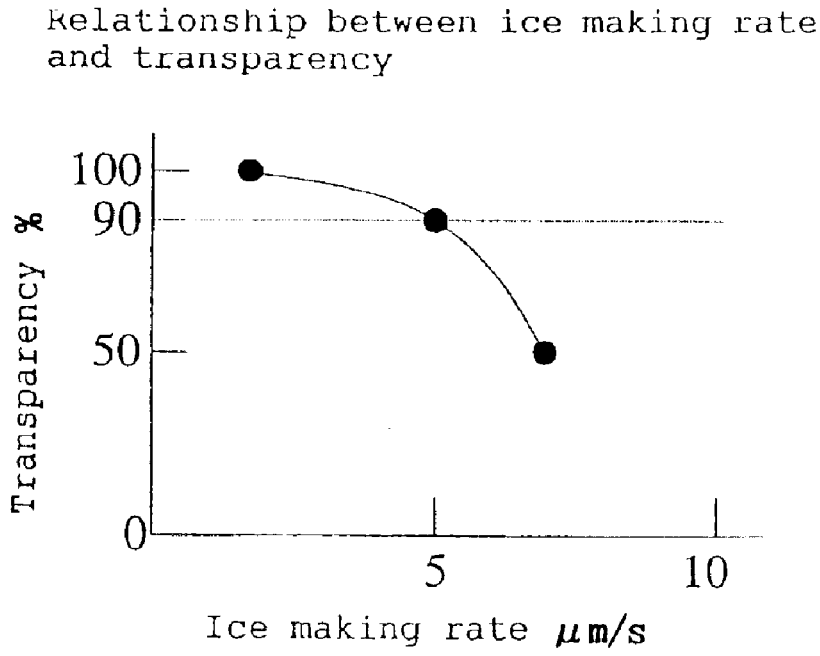
FIG. 6 is a graph showing a relationship between an ice making rate and the transparency according to an embodiment of the invention.

A relationship between an ice making rate and a transparency is shown in FIG. 6. The ice making rate is determined by dividing, by a predetermined time, the thickness of the ice measured after a predetermined lapse of time after starting of making of the ice. FIG. 6 is a graph showing a relationship between the ice making rate and the measured transparency of the resulting ice. As can be seen from FIG. 6, if the ice making rate is equal to or lower than 5 μm/s, the transparency of the resulting ice is equal to or higher than 90%.

Furthermore, visual observations of the resulting ice were made to check the clearness of the ice. Then, the visual observations proved that an ice having a transparency of 90% or higher has an adequate clearness. On the other hand, it was proved that if the transparency of the resulting ice is lower than 90%, the clearness of the ice visually observed decreases significantly.

Thus, it can be said that when the ice making rate is equal to or lower than 5 μm/s, a clear ice can be made.

As shown in FIG. 1, the dissolved air forced out of the ice 3 exists in water 2 in the form of excessive air. However, if water is supplied in an amount of about 0.2–1 ml at a time, the thickness of the layer of water 2 is extremely thin, specifically about 0.1–0.5 mm, and the excessive air is released from water 2 to the atmosphere. Thus, the excessive air concentration required for producing an air bubble (about eight times the saturation air concentration) cannot be attained.

In other words, if the layer of water 2 is thick, it takes time for air to pass through the layer of water 2, and thus, the air concentration in water 2 may become significantly high to produce an air bubble. To the contrary, if the thickness of the layer of water 2 is extremely thin, specifically, about 0.1–0.5 mm, air is released into the atmosphere before it forms an air bubble.

However, if the amount of water supplied at a time is such small, the whole water supplied tends to be supercooled. Therefore, by supplying the following water before the whole water 2 is supercooled, the temperature of the upper part of water 2 increases by the supplied water while keeping the part of water 2 near the solid-liquid interface supercooled to prevent the whole water 2 from being supercooled and from becoming a sherbet-like ice.

In addition, since water is intermittently supplied, there is constantly a surface of a liquid layer which is in contact with the atmosphere in the upper part of the liquid layer. Thus, the excessive molecules of air are released to the atmosphere through the liquid layer without forming an air bubble core. A primary factor that makes the resulting ice cloudy because of air bubbles is that the upper part of water in the ice making cell is frozen and the excessive molecules of air are not released to the atmosphere. According to this embodiment, however, part of the upper part of water is kept in a liquid layer, and therefore, the excessive molecules of air are not trapped in the resulting ice.

Besides air bubbles, deposition of hard ions causes the resulting ice to be cloudy. In the following, a method of making a clear ice by preventing deposition of impurities, such as hard ions, contained in tap water or well water will be described. In general, tap water contains, in addition to hydrogen ions ($H^+$) and hydroxyl ions ($OH^-$) resulting from water ($H_2O$), many kinds of ions including dissolved air ($O_2$, $N_2$, $CO_2$ or the like), hydrogencarbonate ions ($HCO^{3-}$) resulting from dissolution of $CO_2$, sodium ions ($Na^+$), potassium ions ($K^+$), calcium ions ($Ca^{2+}$), magnesium ions ($Mg^{2+}$), chlorine ions ($Cl^-$), nitrate ions ($NO_3^{31}$ ), sulfate ions ($SO_4^{2-}$), hypochlorite ions ($OCl^-$) and silicate ions ($SiO_4^{4-}$)

While pure ice is a highly pure crystal which is composed only of hydrogen bonds of $H_2O$ and contains no impurity, tap water contains a large amount of impurities as described above. Cations and some anions cannot be removed unless a special water treatment is conducted. When water is being frozen, they are forced into water that has not been frozen, and condensed to be deposited, thereby causing the resulting ice to be cloudy.

It has been found that if water is supplied in an amount of about 0.2–1 ml at a time and the ice making rate is set at a range of 2–5 82 m/s, the impurity ions are not forced into water that has not been frozen, some of them being trapped in the ice in the form of ions and the rest being trapped therein in the form of deposit, and an ice having a transparency of 90% or higher can be made. That is, even when impurities exist in the ice, if the impurities have a size of 1 μm or smaller and are not condensed, they cannot be visually observed and thus, a clear ice can be obtained though the transparency is lowered.

Figure 4:
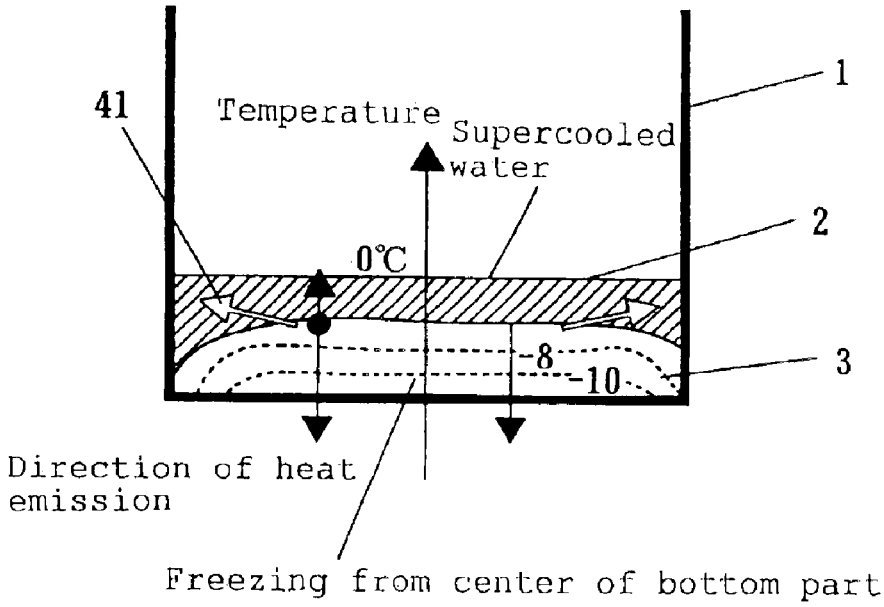
FIG. 4 is a cross sectional view illustrating diffusion of impurities according to an embodiment of the invention.

In addition, if the temperature of the ice making tray 1 is higher in the side face thereof than the bottom part thereof as shown in FIG. 4, the impurities tend to be widely diffused toward the side face of the ice making tray. Thus, a clear ice can be made from tap water or well water containing impurities.

In conventional ice making, water in the ice making cell is cooled from six directions to be frozen. Therefore, impurities are diffused toward the center of the ice and deposited there, thereby degrading the transparency of the ice. However, according to this invention, since most impurities are diffused toward the surfaces of the ice, they are inconspicuous even if deposited, and an ice with a high transparency can be obtained.

Figure 5:
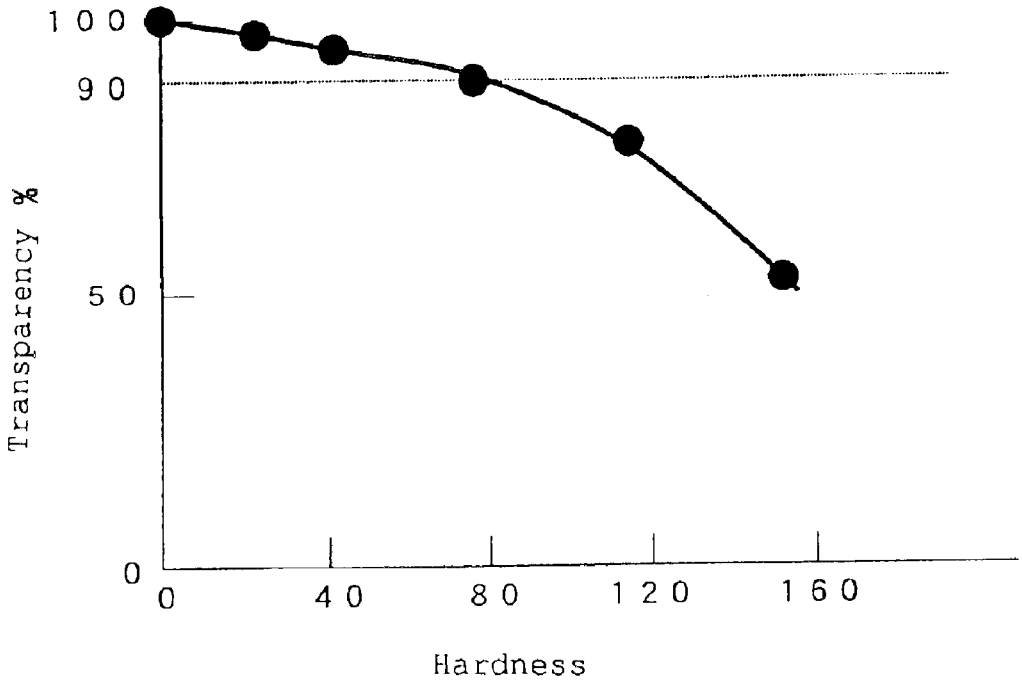
FIG. 5 is a graph showing a relationship between hardness and transparency according to an embodiment of the invention.

FIG. 5 shows a relationship between the hardness of water used and the transparency of the resulting ice. As can be seen from this drawing, according to this invention, an ice with a transparency of 90% can be obtained as far as the hardness is approximately below 80.

As described above, according to this embodiment, the following advantages are provided.

That is, conventionally, if an ice having a transparency of 90% or higher is to be made in a household refrigerator, it takes four hours or more. However, according to this invention, the time to make such an ice can be significantly reduced; it takes one to two hours from water supply to ice release. In addition, the transparency of 90% or higher can be assured with a hardness of about 80, a clear ice can be readily made in homes except for those in a specific region.

(Embodiment 2)

Figure 7:
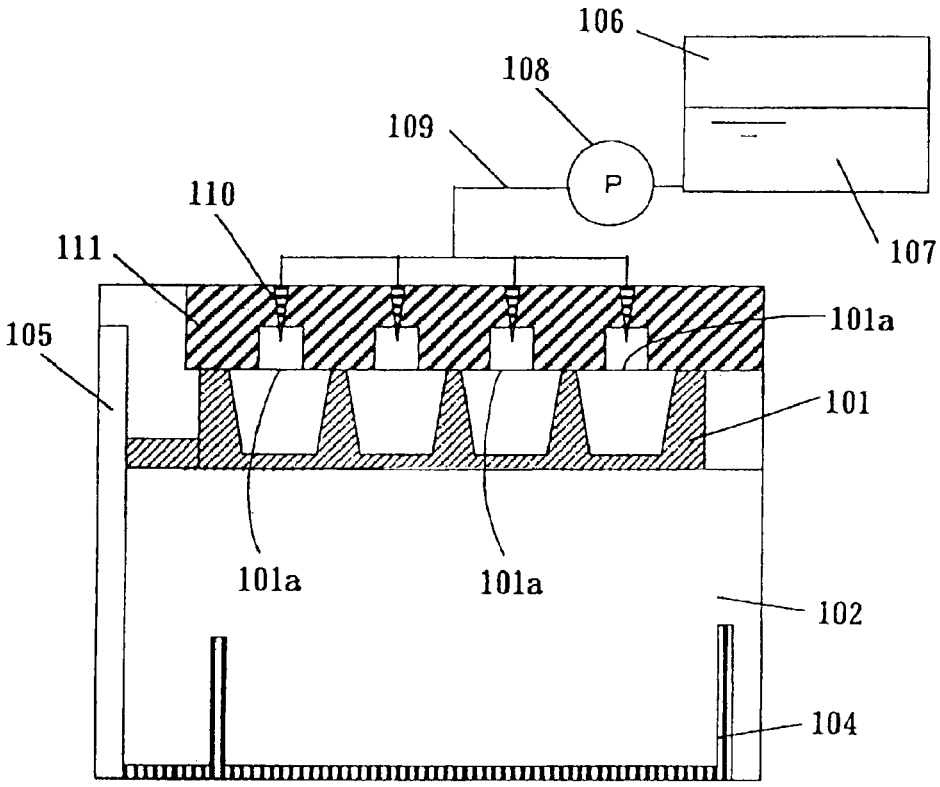
FIG. 7 is a cross sectional view of an ice making apparatus illustrating an embodiment of the invention.
Figure 8:
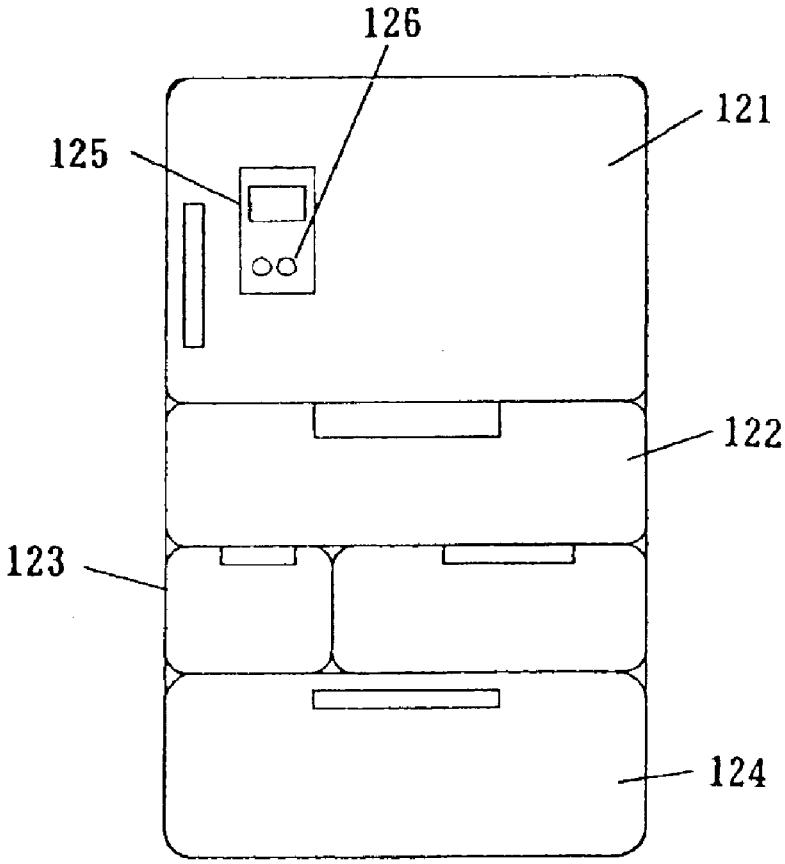
FIG. 8 is a front view of a refrigerator.

An ice making apparatus for making a clear ice is shown in FIG. 7. The ice making apparatus is incorporated in a refrigerator shown in FIG. 8. In FIG. 8, reference numeral 121 denotes a refrigerating room, reference numeral 122 denotes a vegetable room, reference numeral 123 denotes an ice making room, reference numeral 124 denotes a freezing room, reference numeral 125 denotes a control panel and reference numeral 126 denotes an ice making start button.

A freezing compartment 102, which serves as a freezing space of the ice making apparatus shown in FIG. 7 described above and is kept at a temperature at which water is crystallized, has a door 105. An opening 101*a* is provided at the top of an ice making tray 101.

The ice making tray 101 may be made of a resin, such as PP or PE, or a metal, such as aluminum. If the ice making tray is made of a resin, the thickness of the resin is varied between the bottom part and the upper part in such a manner that the bottom part is thinner than the upper part to provide better heat conduction in the bottom part than in the upper part, thereby providing a temperature difference between the upper part and the bottom part of the ice making tray. If the ice making tray is made of a metal, such as aluminum, the thickness of a heat insulating material is varied in such a manner that it is thicker in the upper part than in the bottom part, thereby providing a temperature difference between the upper part and the bottom part.

Feed water is contained in a feed water tank 106 installed in a refrigerator (not shown) and is previously kept at a low temperature. The feed water is intermittently supplied to the ice making tray 101 through a water feed nozzle 110 by means of a water feed pump 108. The feed water tank 106, the water feed pump 108, a water feed pipe 109 and the water feed nozzle 110 constitute a water supply system of this invention.

Figure 9:
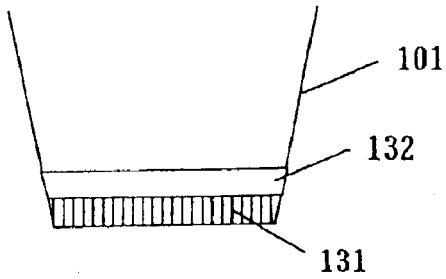
FIG. 9 is a cross sectional view illustrating freezing of water in an ice making tray.

The top of the ice making tray 101 is covered with a heat insulating material 111. The above-described water feed nozzle 110 penetrates through the heat insulating material 111 from the outside to appear at the top of the ice making tray 101. Variation of the temperature in the freezing compartment 102 is preferably as small as possible, and the temperature is preferably kept at a constant value. For example, the temperature in the freezing compartment 102 is set at −15° C., the ice making tray 101 is installed as shown in FIG. 7, the door 105 is closed, the ice making start button 126 shown in FIG. 8 is pushed, and then, after a lapse of about 5 minutes, supply of water is started. This is because, in order to turn the supplied water into a clear ice, the following supply of water needs to be conducted before the water having been supplied is completely frozen (when ice 131 and water 132 coexist), as shown in FIG. 9. Though only 0.2 ml of water is supplied at a time, a small number of bubbles are generated when the water is frozen. However, since the following supply of water is started before the generated air bubbles are trapped in the ice, the air bubbles are prevented from being trapped in the ice, and water continues to be frozen. Repeating this procedure can produce a clear ice not containing an air bubble.

Tap water having a hardness of about 50 contains hard ions or dissolved silica, which may constitute an air bubble core. However, since the following supply of water is started before an air bubble is produced, small part of the hard ions or dissolved silica is contained in the resulting ice without constituting air bubble cores, and most of them are forced out of the ice and exist on the surface of the ice or the side face of the ice making tray. Thus, they do not compromise the transparency of the ice.

By supplying water intermittently in this way, it becomes possible to turn 10 ml of water into a clear ice in about 2 hours.

(Embodiment 3)

Figure 10:
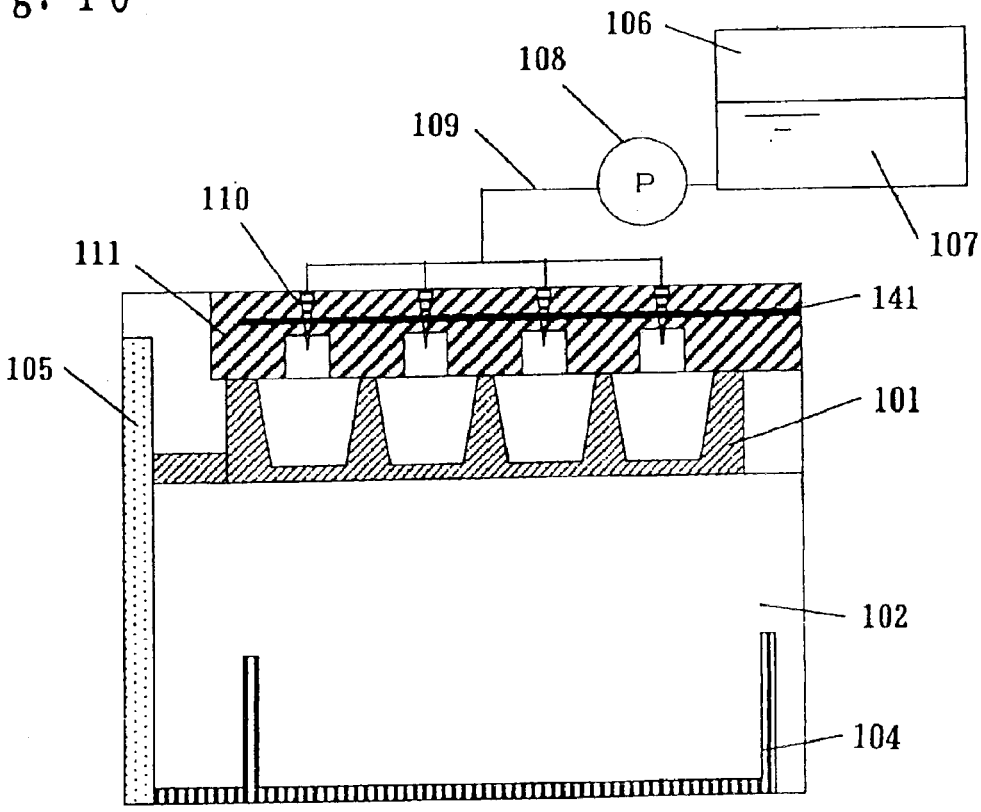
FIG. 10 is a cross sectional view of an ice making apparatus illustrating an embodiment of the invention.

In the following, a third embodiment for making a clear ice will be described in detail with reference to FIG. 10.

The third embodiment differs from the embodiment 2 in that a heater 141 is provided in the heat insulating material 111. In the embodiment 2, depending on the capability of the heat insulating material 111 used, a high heat insulating capability prevents the temperature difference between the upper part and the bottom part of the ice making tray 101 from being provided. Thus, the heat insulating material has to have a somewhat low capability. However, in this embodiment 3, the heater 141 is provided in the heat insulating material 111, so that even if the heat insulating material 111 has a high heat insulating capability, a temperature difference can be provided between the upper part and the bottom part of the ice making tray 101. Furthermore, when ice making is completed, water in the water feed nozzle 110 and water feed pipe 109 needs to be removed, and a small amount of water remaining therein may be frozen and cause the water feed nozzle 110 to be clogged. In such a case, the heater 141 can heat the water feed nozzle 110, thereby preventing it from being clogged with frozen water. Therefore, even if water in the water feed nozzle 110 is frozen when ice making is completed, the heater 141 has made the frozen water molten at the time of the following ice making, and thus, the water feed nozzle is not clogged.

The process of making an ice is the same as in the embodiment 2. For example, the temperature in the freezing compartment 102 is set at −15° C., the ice making tray 101 is installed as shown in FIG. 7, the door 105 is closed, the ice making start button shown in FIG. 8 is pushed, and then, after a lapse of about 5 minutes, supply of water is started. This is because, in order to turn the supplied water into a clear ice, the following supply of water needs to be conducted before the water having been supplied is completely frozen (when ice 131 and water 132 coexist), as shown in FIG. 9. Though only 0.2 ml of water is supplied at a time, a small number of bubbles are generated when the water is frozen. However, since the following supply of water is started before the generated air bubbles are trapped in the ice, the air bubbles are prevented from being trapped in the ice, and water continues to be frozen. Repeating this procedure can produce a clear ice not containing an air bubble.

Tap water having a hardness of about 50 contains hard ions or dissolved silica, which may constitute an air bubble core. However, since the following supply of water is started before an air bubble is produced, small part of the hard ions or dissolved silica is contained in the resulting ice without constituting air bubble cores, and most of them are forced out of the ice and exist on the surface of the ice or the side face of the ice making tray. Thus, they do not compromise the transparency of the ice.

By supplying water intermittently in this way, it becomes possible to turn 10 ml of water into a clear ice in about 2 hours.

(Embodiment 4)

A fourth embodiment for making a clear ice will be described in detail with reference to FIG. 11. In the embodiment 2, water is supplied five minutes after the ice making tray 101 is installed in the freezing compartment 102 and the ice making start button 126 is pushed. However, the ice making tray 101 may not be cooled sufficiently in five minutes. Therefore, in this embodiment 4, a temperature sensor 151 is provided at the bottom part of the ice making tray 101, and the timing of supplying water is determined in accordance with the temperature variation.

Figure 11:
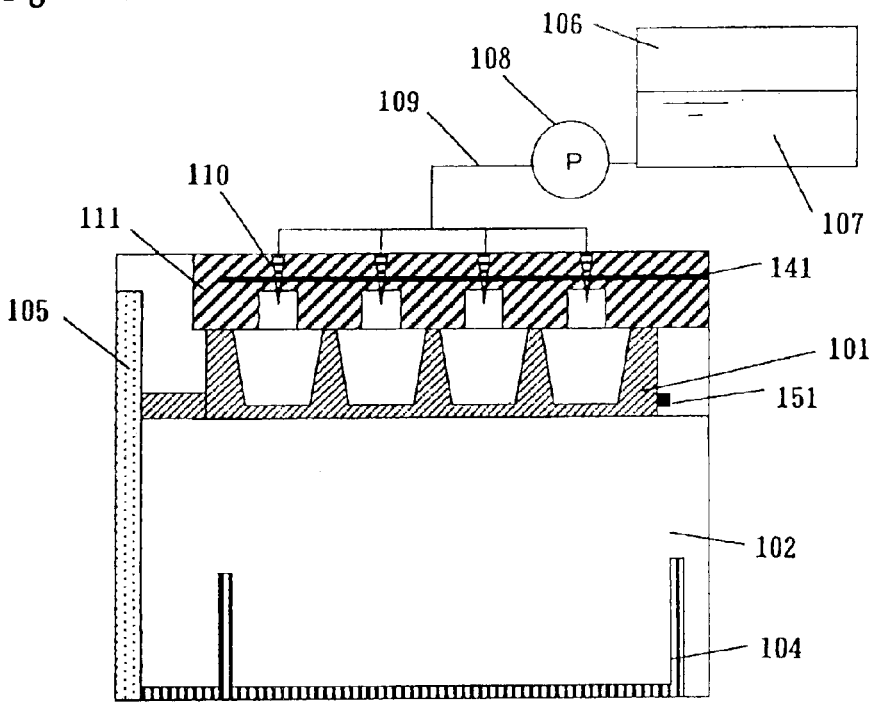
FIG. 11 is across sectional view of an ice making apparatus illustrating an embodiment of the invention.
Figure 12:
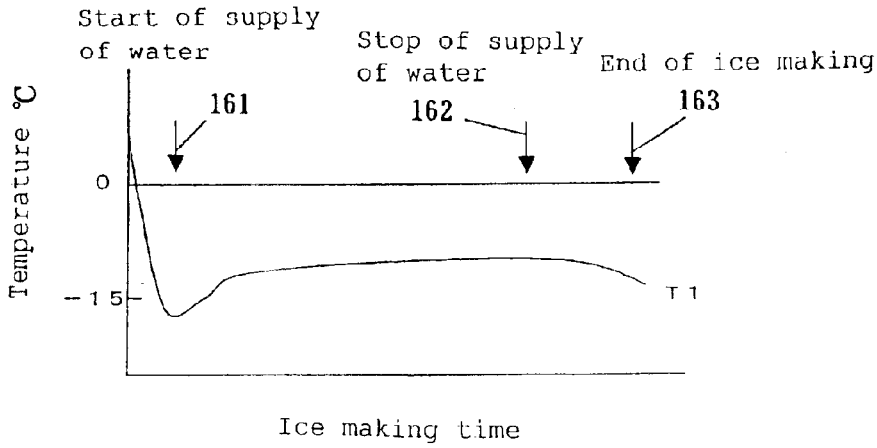
FIG. 12 is a graph showing a change of temperature according to an embodiment of the invention.

When the ice making tray 101 is installed in the freezing compartment 102 the temperature of the inside of which is kept at −15° C. as shown in FIG. 11, the temperature measured by the temperature sensor 151 varies as shown in FIG. 12. When a temperature of the bottom part of the ice making tray 101 equal to or lower than −10° C. is detected as indicated by an arrow 161, supply of water is started. If the door 105 of the freezing compartment 102 has not been opened for a long time, the timing of starting supply of water can be determined based on an elapsed time, as in the embodiment 2. However, if the door 105 has been opened for a long time and the temperature in the freezing compartment 102 has increased, it is preferred that supply of water is started based on the monitored temperature of the bottom part of the ice making tray 101 rather than an elapsed time.

When supply of water is started, the temperature shown by the temperature sensor 151 increases slightly because of the temperature of water and a latent heat generated when water changes into an ice. As water is further supplied, the temperature shown by the temperature sensor 151 continues to increase, and stops increasing at about −8° C. If the water supply interval is too long, or the amount of water supplied at a time is too small, the temperature increase is small, and thus, water is entirely frozen every time water is supplied, and a small air bubble generated remains in the resulting ice. To the contrary, if the water supply interval is too short, or the amount of water supplied at a time is too large, the temperature continues to increase, so that a too large amount of water remains without being frozen, and thus, the resulting ice contains many air bubbles as in the case of the conventional ice making process in which the ice making tray is first filled with water.

Therefore, when the following supply of water is started before the water having already been supplied is entirely frozen as described with reference to the embodiment 2, if the temperature increases too fast, the amount of water supplied can be increased slightly, or the water supply interval can be shortened slightly. If the temperature increases too slowly after supply of water, the amount of water supplied can be reduced slightly, or the water supply interval can be expanded slightly. When supply of water is stopped at a point indicated by an arrow 162, the temperature (T1) by the temperature sensor 151 begins to decrease as shown in FIG. 12. By detecting the temperature of the bottom part of the ice making tray 101 to optimally change the water supply interval and the amount of supplied water, it becomes possible to constantly make an ice with a transparency close to 100%.

(Embodiment 5)

Figure 13:
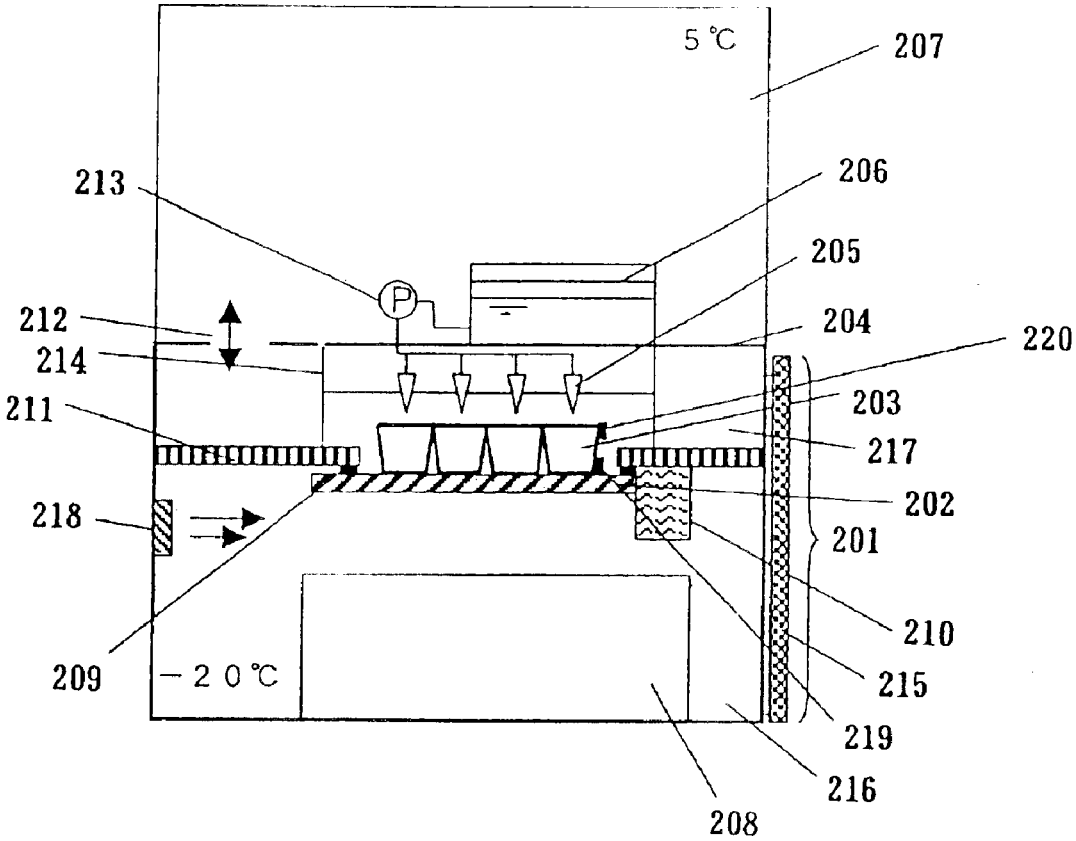
FIG. 13 is a cross sectional view of an ice making apparatus illustrating an embodiment of the invention.

An ice making apparatus for making a clear ice is shown in FIG. 13. An ice making room 201 is separated into a space B (referred to as a freezing space 216, hereinafter) the inside of which is kept at a temperature lower than 0° C. and a space A (referred to as a refrigerating space 217, hereinafter) the inside of which is kept at a temperature higher than 0° C. by a partition including a heat insulating material 211, a packing 209 filling a window formed in the partition, and a cooling plate 202.

A significant difference from conventional ice making is that ice making is conducted in the refrigerating space 217 rather than in the freezing space 216, and the freezing space 216 is used to store resulting ices. For example, an ice making tray made of PP (polypropylene) (referred to as an ice making tray 203, hereinafter) is disposed on the cooling plate 202, and thus, is located on the side of the refrigerating space 217. The cooling plate 202 is made of a metal which has a high heat conductivity, such as Al and Cu.

Figure 14:
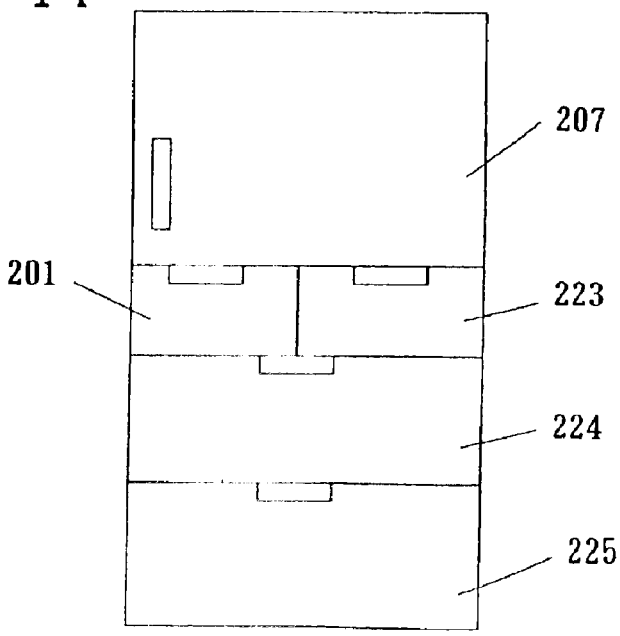
FIG. 14 is a front view of a refrigerator illustrating an embodiment of the invention.

In addition, as shown in FIG. 14, a refrigerating room 207 is located above and adjacent to the ice making room 201, and feed water is contained in a feed water tank 206 provided in the refrigerating room 207 so that it is previously cooled, and intermittently supplied to the ice making tray 203 through a water feed nozzle 205 by means of a water feed pump 213 (for example, such as a gear pump and a piezoelectric pump).

The ice making tray 203 and the water feed nozzle 205 are disposed in a metal tray 214 which is made of Al, for example. The refrigerating space 217 of the ice making room 201 and the refrigerating room 207 are communicated with each other via an air vent 212 so as to keep the metal tray 214 at the same temperature as the refrigerating room 207 (>5° C.), so that the refrigerating space 217 can be constantly kept at a temperature higher than that in the freezing space 216. Here, the ice making tray 203 and the water feed nozzle 205 are disposed in the metal tray 214 in order to prevent an unpleasant smell of a food in the refrigerating room 207 from being clung to the ice.

With such an arrangement, the temperature of the bottom surface of the ice making tray 203 is below the freezing point, and the temperature of the upper part thereof is 2–3° C. In this way, a temperature difference is provided between the bottom surface and the upper part, and thus, water is gradually frozen from the bottom surface.

For example, thermistors 219 and 220 serving as temperature detecting means are attached to the bottom part and upper part of the ice making tray 203, respectively, and when the thermistors 219 attached to the bottom part of the ice making tray 203 shows a temperature equal to or lower than −18° C., the water feed pump 213 is actuated to start intermittent supply of water. For example, 0.2 ml of water is supplied at a time every 2 minutes, and this intermittent supply of water continues for 1 hour and 45 minutes and then is stopped (control means is not shown) When the temperature shown by the thermistors 220 becomes equal to or lower than −5° C., an actuator 210 is activated to release the ice from the tray.

While the above description has been made taking the thermistors as an example of the temperature detecting means, a thermocouple, such as a chromel-alumel thermocouple, may be used. When the 0.2 ml of water is frozen from the bottom surface, it emits a latent heat, whereby detects the temperature shown by the thermistors 219 increases slightly, and an extremely small air bubble is generated in the supplied water at a region a little above the bottom surface of the ice making tray 203 with freezing.

If the supplied water is entirely frozen, the generated air bubble is trapped in the ice and makes the ice cloudy. However, since the following supply of water is started before the entire supplied water is frozen, the generated air bubble is diffused through the newly supplied water without being trapped in the ice, and the newly supplied water begins to be frozen. Repeating this procedure can produce a clear ice not containing an air bubble. Tap water having a hardness of about 50 contains hard ions or dissolved silica, which may constitute an air bubble core. However, since the following supply of water is started before an air bubble is produced, small part of the hard ions or dissolved silica is contained in the resulting ice without constituting air bubble cores, and most of them are forced out of the ice and deposited on the surface of the ice or the ice making tray. Thus, they do not compromise the transparency of the ice.

In addition, since the feed water tank, the water feed pump and the water feed nozzle are all located on the side of the refrigerating space where the temperature is kept higher than 0° C., a heater or the like for preventing freezing is not needed, and the temperature of −20° C. of the ice making room and the temperature of 5° C. of the refrigerating room, which are set in the refrigerator, can be used.

Figure 16:
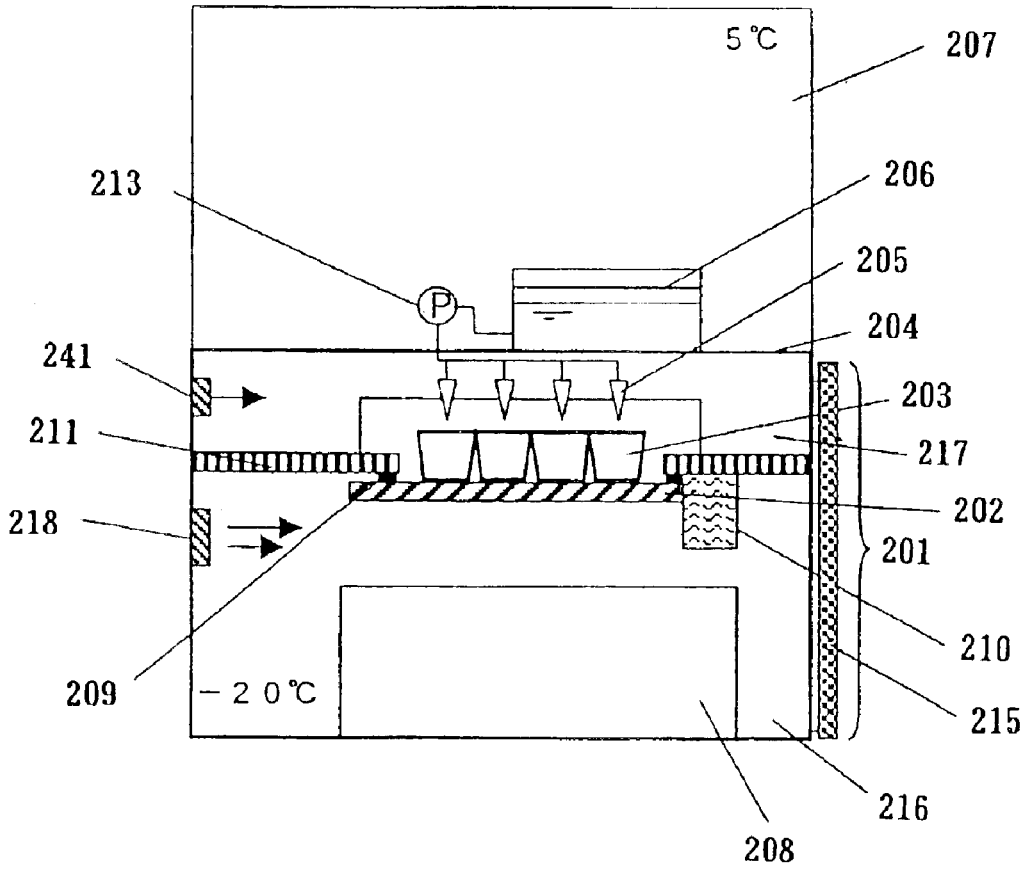
FIG. 16 is across sectional view of an ice making apparatus illustrating an embodiment of the invention.

In the above description, the air vent 212 is provided to keep the temperature in the refrigerating space 217 at the temperature in the refrigerating room 207. However, if a cold air outlet 241 is provided to the refrigerating space 217 as shown in FIG. 16, the metal tray 214 for block an unpleasant smell from the refrigerating room 207 is not needed, and the entire structure is simplified.

(Embodiment 6)

Figure 15:
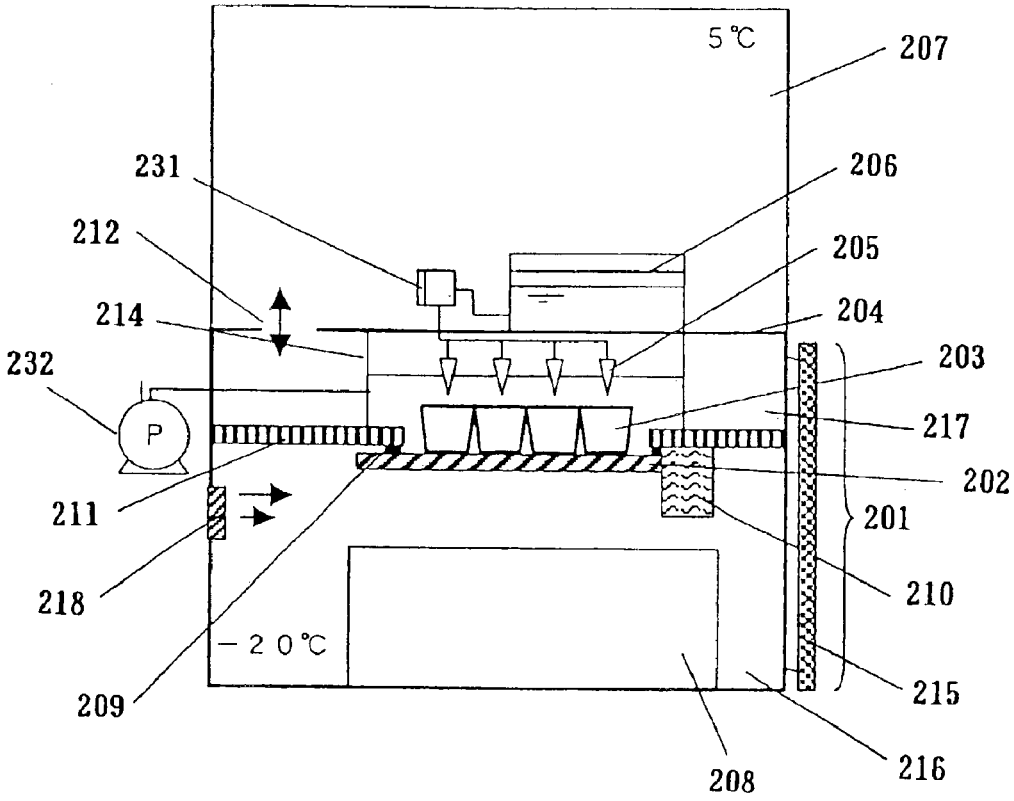
FIG. 15 is a cross sectional view of an ice making apparatus illustrating an embodiment of the invention.

In the following, a sixth embodiment for making a clear ice will be described in detail with reference to FIG. 15. This embodiment 6 differs from the embodiment 5 in that a solenoid valve 231 is used instead of the water feed pump 213, and a vacuum pump 232 for reducing the pressure in the metal tray 214 and degassing the supplied water is connected to the metal tray 214.

The metal tray 214 has a minimum volume to take some of the load off the vacuum pump 232. It is known that the concentration of the dissolved gas in the water is proportional to the concentration thereof in the gas phase according to the Henry's law. Therefore, if the concentration of air in the gas phase is reduced, the concentration of the dissolved gas in the water can be reduced, and air bubble generation during freezing of water can be suppressed. However, it should be noted here that since the vapor pressure of water at 0° C. is 4.58 mmHg, if the degree of vacuum goes beyond this level, the supplied water is evaporated. Therefore, the pressure in the metal tray 214 is set at a value falling within a range of 0.01 atmospheres, or 7.6 mmHg, to 0.1 atmospheres, or 76 mmHg, whereby the dissolved gas in the water can be removed while suppressing evaporation of the water and some of the load can be taken off the vacuum pump 232.

By opening the solenoid valve 231, water can be supplied to the ice making tray 203, which is composed of eight cells, by the action of an internal pressure difference between the feed water tank 206 and the metal tray 214. If 0.2 ml of water is supplied to each cell, 1.6 ml of water is supplied in total. As described above, a primary factor that makes the ice cloudy is the dissolved gas in the water. Therefore, if the concentration of the dissolved gas in the water is set at 1/10 to 1/100, the amount of air bubbles trapped in the ice is reduced in accordance with the dissolved air concentration, and the transparency of the ice is improved.

Regarding one cell, according to this embodiment, degassing of water is started at the moment when 0.2 ml of water enters into the metal tray 214, freezing of water is started at the time when the water is supplied into the ice making tray 203 and attains its freezing point. In this process, little air bubble is generated, and then, the following supply of water is started. Even if tap water having a hardness of 250, which contains hard ions or dissolved silica that is to constitute air bubble cores, is used, no air bubble is generated, and then, the following supply of water is started. The hard ions or dissolved silica constitute no air bubble core, and small part of them is contained in the resulting ice and most of them are forced out of the ice and deposited on the surface of the ice or the ice making tray. Thus, they do not compromise the transparency of the ice.

If the ice making tray is made of PP, 10 ml of water can be turned into a clear ice having a transparency close to 100% in about 2 hours. If the ice making tray 203 is made of a metal such as Al, 10 ml of water can be turned into a clear ice having a transparency of about 90% in about 1 hour. In addition, since the feed water tank 206, the solenoid valve 231 and the water feed nozzle 205 are all located on the side of the refrigerating space where the temperature is kept higher than 0° C., a heater or the like for preventing freezing is not needed, and the temperature of −20° C. of the ice making room and the temperature of 5° C. of the refrigerating room, which are set in the refrigerator, can be used.

Of course, in this embodiment also, thermistors (not shown) serving as temperature detecting means may be provided at the bottom part and the upper part of the ice making tray 203, thereby realizing the same operation as that in the embodiment 5.

Figure 17:
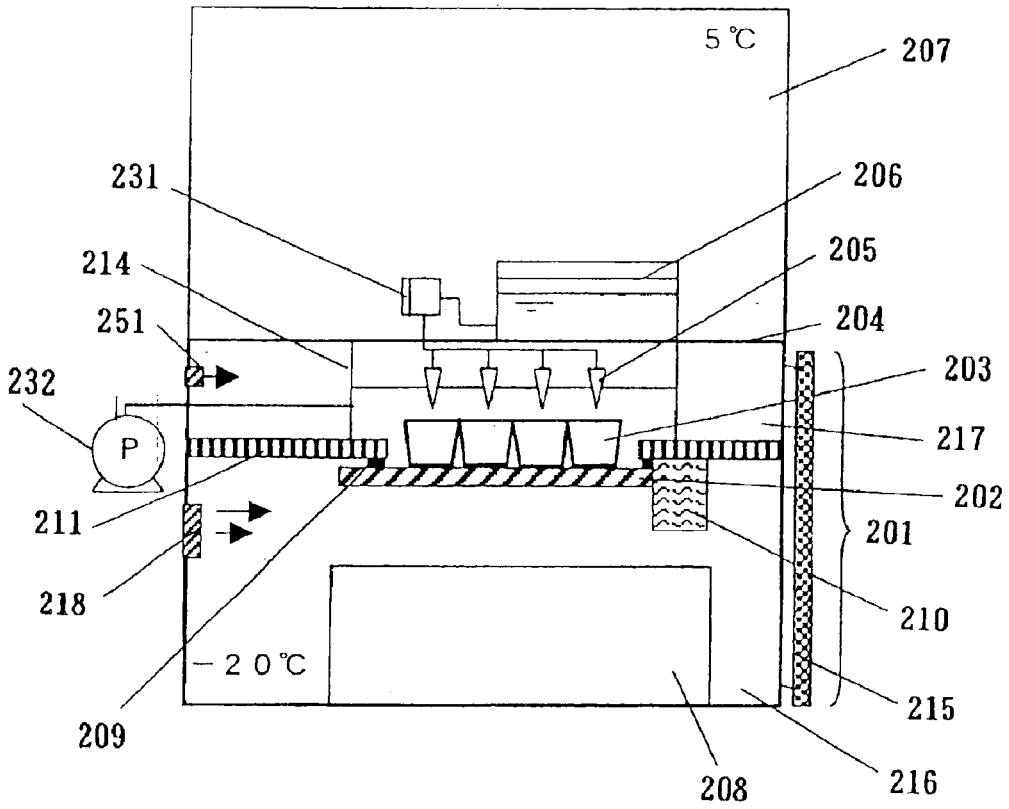
FIG. 17 is a cross sectional view of an ice making apparatus illustrating an embodiment of the invention.

In addition, in this embodiment also, as shown in FIG. 17, instead of providing the air vent 212 between the refrigerating space 217 and the refrigerating room 207, an air outlet 251 may be provided to the refrigerating space 217. However, since evacuation is needed in this embodiment, the metal tray 214 is necessary, and therefore, the structure cannot be simplified unlike the embodiment 5. However, since the temperature in the refrigerating space 217 can be controlled separately, an ice having an extremely high transparency can be made.

(Embodiment 7)

Figure 18:
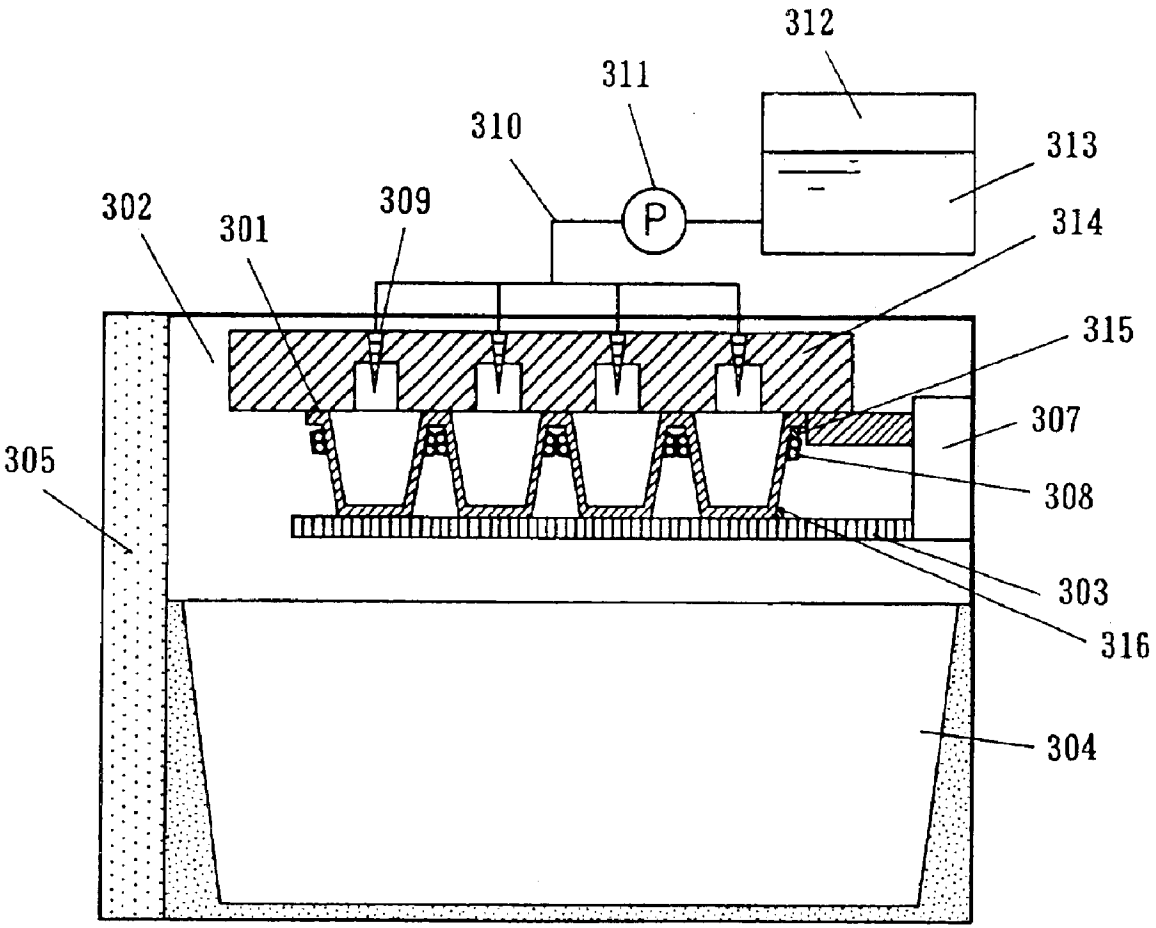
FIG. 18 is a cross sectional view of an ice making apparatus according to an embodiment of the invention.

An ice making apparatus for making a clear ice is shown in FIG. 18. An ice making tray 301 is provided in a freezing compartment 302 having an openable door 305. A heater wire 308, which is an example of heating means of this invention, such as a nichrome wire coated with an insulating film, is sandwiched between metal films having a high heat conductivity, such as aluminum foils. The heater wire 308 sandwiched between the metal films having a high heat conductivity is wound around the upper side face of the ice making tray 301. The bottom part of the ice making tray 301 is in contact with a cooling plate 303, which is composed of cooling means such as an aluminum plate for keeping the bottom part of the ice making tray at a temperature lower than that of the upper side face thereof. If the cooling plate 303 is not used, the cold air stream passing along the bottom surface of the ice making tray 301 can be enhanced.

The reason why the heater wire 308 is sandwiched between the metal films having a high heat conductivity or the like is that: variations of the temperature in the vicinity of the side face of the ice making tray 301 need to be suppressed; and when the supplied water accumulates and the solid-liquid interface and the water surface approach the top of the ice making tray 301, cooling, rather than heating, becomes needed, and when energization to the heater wire 308 is stopped, the temperature of the upper side face of the ice making tray needs to be reduced quickly.

The ice making tray 301 may be made of a resin, such as PP (polypropylene) or PET (polyethylene terephthalate), or a metal, such as aluminum. The ice making tray 301 and the cooling plate 303 can be horizontally or pivotally reciprocated by an actuator 307. A feed water tank 312 is placed in the refrigerator (not shown) in order to previously keep water 313 at a temperature lower than the room temperature.

Water is supplied, by means of the water feed pump 311, into the ice making tray 301 from the feed water tank 312 through a water feed nozzle 309 which penetrates a heat insulating material 314 for preventing water freezing. The temperatures of the upper side face and the bottom part of the ice making tray 301 are detected by a thermistor 315, which is an example of first temperature detecting means of this invention, and a thermistors 316, which is an example of second temperature detecting means of this invention, respectively.

After an ice is made, the resulting ice is stored in an ice storage compartment 304. Although not shown, driver circuits for the water feed pump 311, the actuator 307 and the heater wire 308, the thermistors 315 and 316, and a horizontal position sensor (not shown) for the ice making tray 301 are connected to control means.

Figure 19:
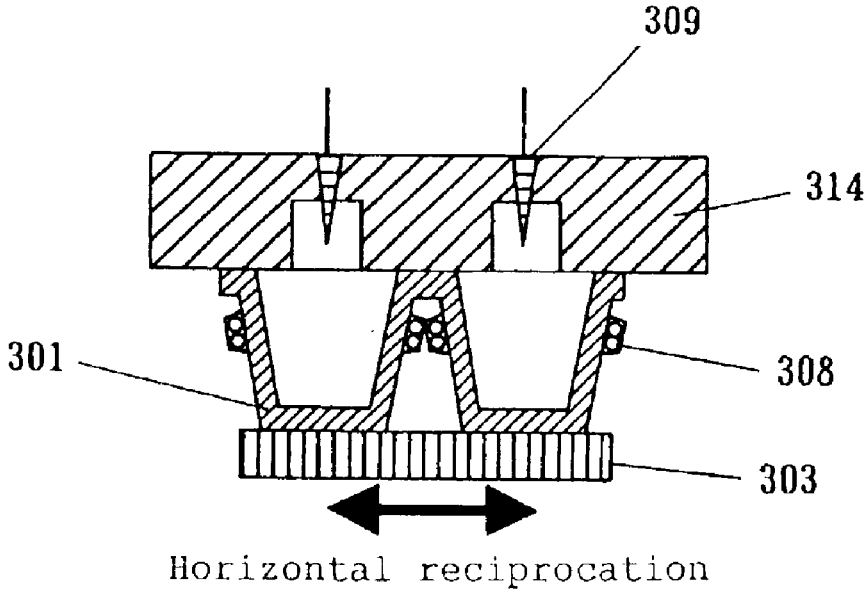
FIG. 19 illustrates vibration of an ice making tray according to an embodiment of the invention.
Figure 19:
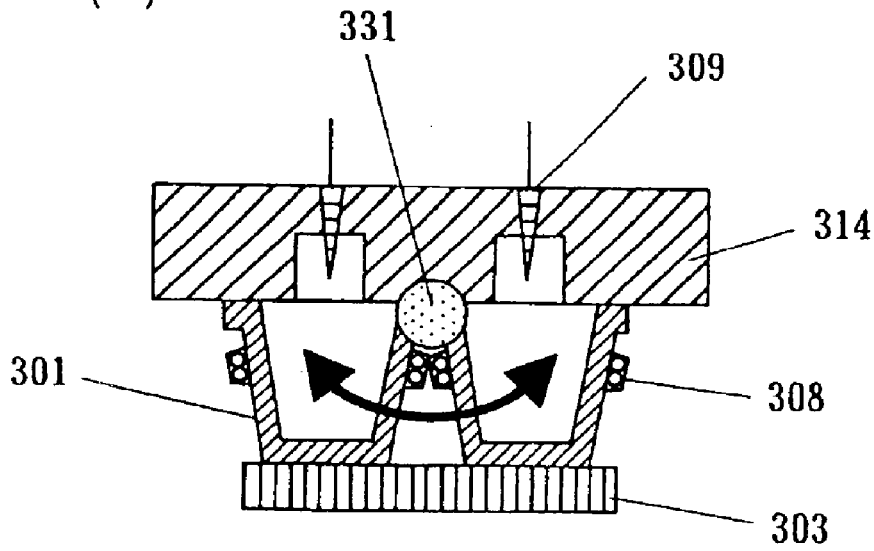

FIGS. 19(*a*) and 19(*b*) show horizontal and pivotal reciprocations of the ice making tray 301, respectively. For example, FIG. 20(*a*) shows the water surface and the solid-liquid interface provided when the ice making tray 301 is reciprocated horizontally to the left, and FIG. 20(*b*) shows a variation of the temperature of the side face A-B of the ice making tray 301 shown in FIG. 20(*a*). The reciprocation is intended to prevent an air bubble generated when water is crystallized or impurities from being trapped in the resulting ice and to effectively diffuse the latent heat generated during crystallization of water, thereby increasing the ice making rate.

If the amount of water supplied at a time is small, the latent heat can be effectively diffused by the reciprocation, and thus, the temperature increase at the solid-liquid interface between the ice and water is small. And, since the water surface is kept moving, even if the water is in a supercooled state, the ice grows quickly along the solid surface, rather than radially in the liquid.

Figure 20:
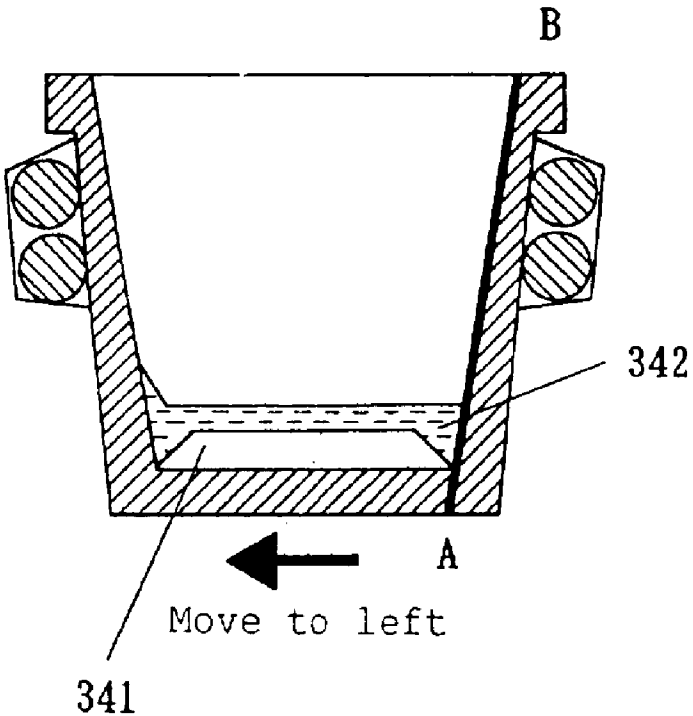
FIG. 20 illustrates ice making in the ice making tray, a condition of the liquid surface and a temperature of a side face of the ice making tray according to an embodiment of the invention.
Figure 20:
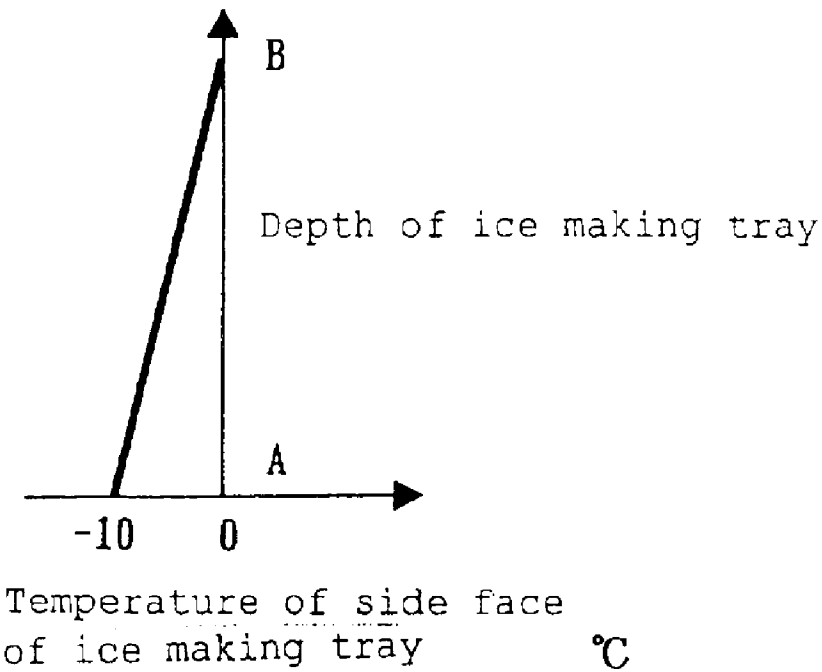

In addition, the temperature of the side face of the ice making tray 301 is, for example as shown in FIG. 20(*b*), −10° C. at the bottom and is kept, by the heater 308, at a temperature near 0° C. at the upper part. Therefore, freezing of water begins from the center of the bottom part. If the temperature of the side face of the ice making tray 301 is higher than that at the center thereof, the dissolved gas or hard ions are not trapped in the ice and diffused to the vicinity of the side face of the ice making tray, and an extremely small amount of impurities is deposited on the side face of the tray. Therefore, the resulting ice is extremely transparent at the core.

Figure 21:
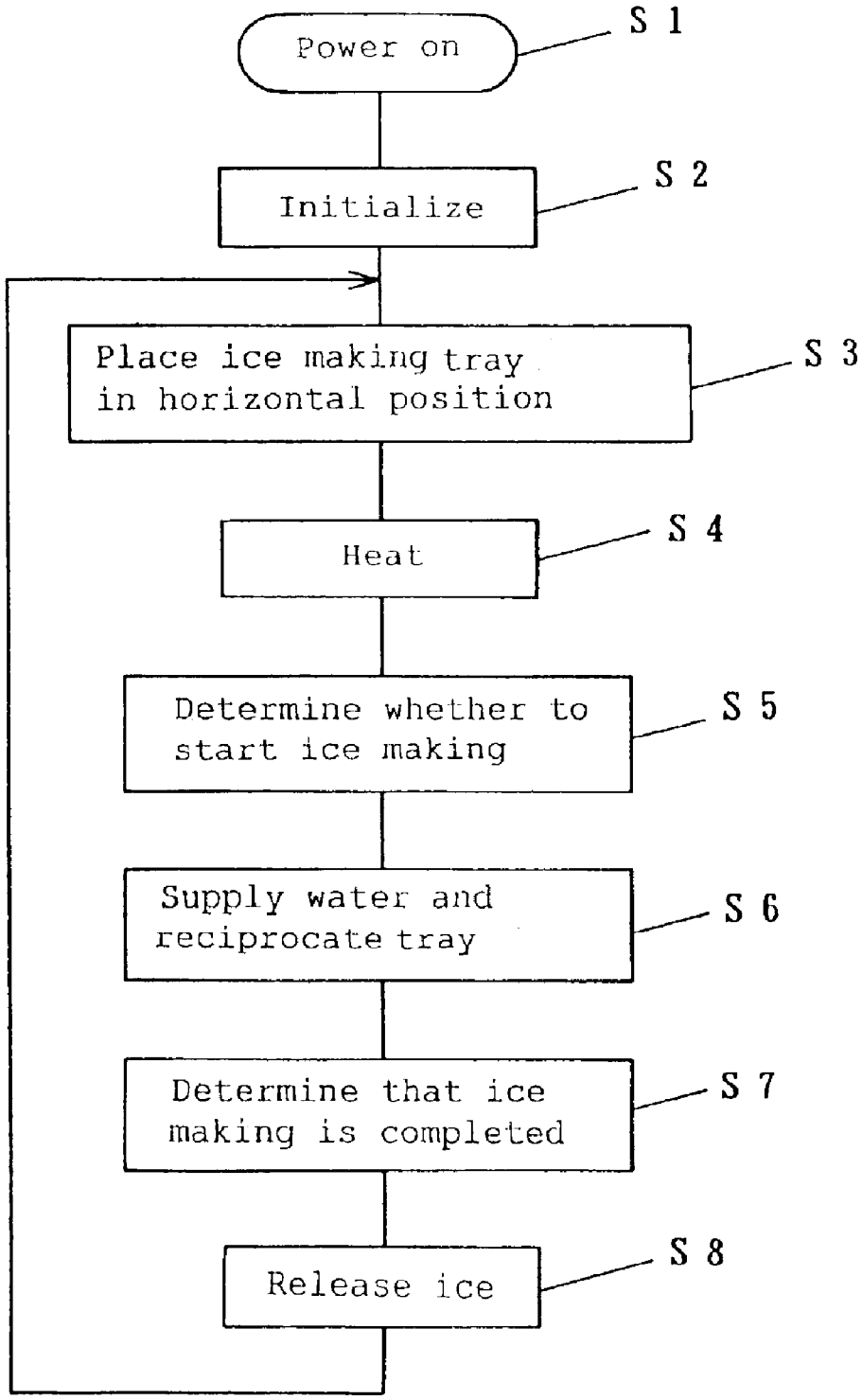
FIG. 21 is a flowchart of control according to an embodiment of the invention.

In the following, embodiments of this invention will be described with reference to control flowcharts shown in FIGS. 21 to 24. As shown in FIG. 21, a control process in the ice making apparatus generally comprises a step of detecting power-on, a step of initialization, a step of placing the ice making tray in a horizontal position, a step of heating, a step of determining whether to start ice making, a step of supplying water, a step of reciprocating the ice making tray, a step of determining whether ice making is completed, and a step of releasing the ice from the ice making tray. After power on and initialization, it is determined whether the ice making tray 301 is in a horizontal position. Then, if the ice making tray 301 is in a horizontal position, the heater wire 308 on the upper side face of the ice making tray 301 is energized to start heating. If the ice making tray 301 is not in a horizontal position, a signal is transmitted to the actuator 307 to cause it to make the ice making tray in a horizontal position.

(Embodiment 8)

Figure 22:
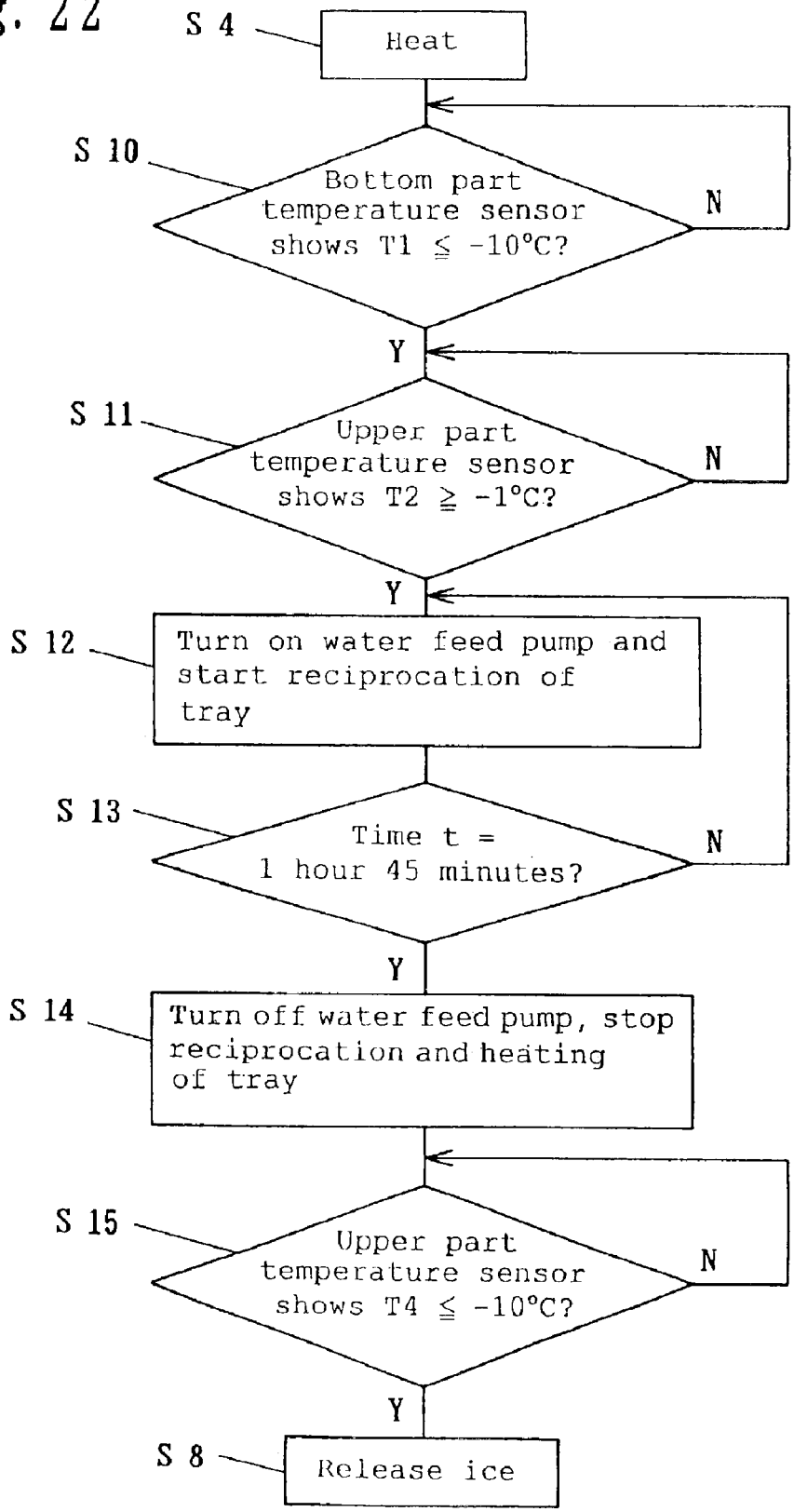
FIG. 22 is a flowchart of control according to an embodiment of the invention.

An embodiment 8 will be described with reference to a control flowchart shown in FIG. 22. As shown in FIG. 22, when the temperature shown by the thermistor 316 provided at the bottom part of the ice making tray 301 becomes equal to or lower than −10° C., the process continues to the following step. Heating by the heater wire 308 continues until the temperature shown by the thermistor 315 provided on the upper side face of the ice making tray 301 becomes equal to or higher than −1° C. when the temperature of the bottom part of the ice making tray 301 is equal to or lower than −10° C. and the temperature of the upper side face thereof is equal to or higher than −1° C., it is determined that ice making can be conducted, and the water feed pump 311 is turned on to start intermittent supply of water.

The amount of water supplied at a time is 0.2 ml, for example, and the water is supplied every 2 minutes. While supplying water, the ice making tray 301 is also reciprocated at a low speed horizontally or pivotally with an rotation angle of about +30 degrees. After a lapse of 1 hour and 45 minutes from the start of supply of water, for example, the water feed pump 311, the reciprocation by the actuator 307 and heating by the heater wire 308 are stopped.

When the temperature of the upper side face of the ice making tray 301 becomes equal to or lower than −10° C., it is determined that ice making is completed, the ice is released from the ice making tray 301 by, for example, the actuator 307 giving a twist to the ice making tray 301, and the released ice is stored in the ice storage compartment 304. When the ice is released, the ice making tray 301 is placed in a horizontal position again, and when it is confirmed that it is in a horizontal position, the heating step in the following ice making process is started.

Since the,upper side face of the ice making tray 301 is kept by heating at a temperature close to 0° C. from the start of supply of water to the end thereof, for example, for 1 hour and 45 minutes, some amount of water remains without being frozen, and it takes 2 hours for the process proceeds from the start of supply of water to the release of the ice. However, an ice having an extremely high transparency can be obtained.

(Embodiment 9)

Figure 23:
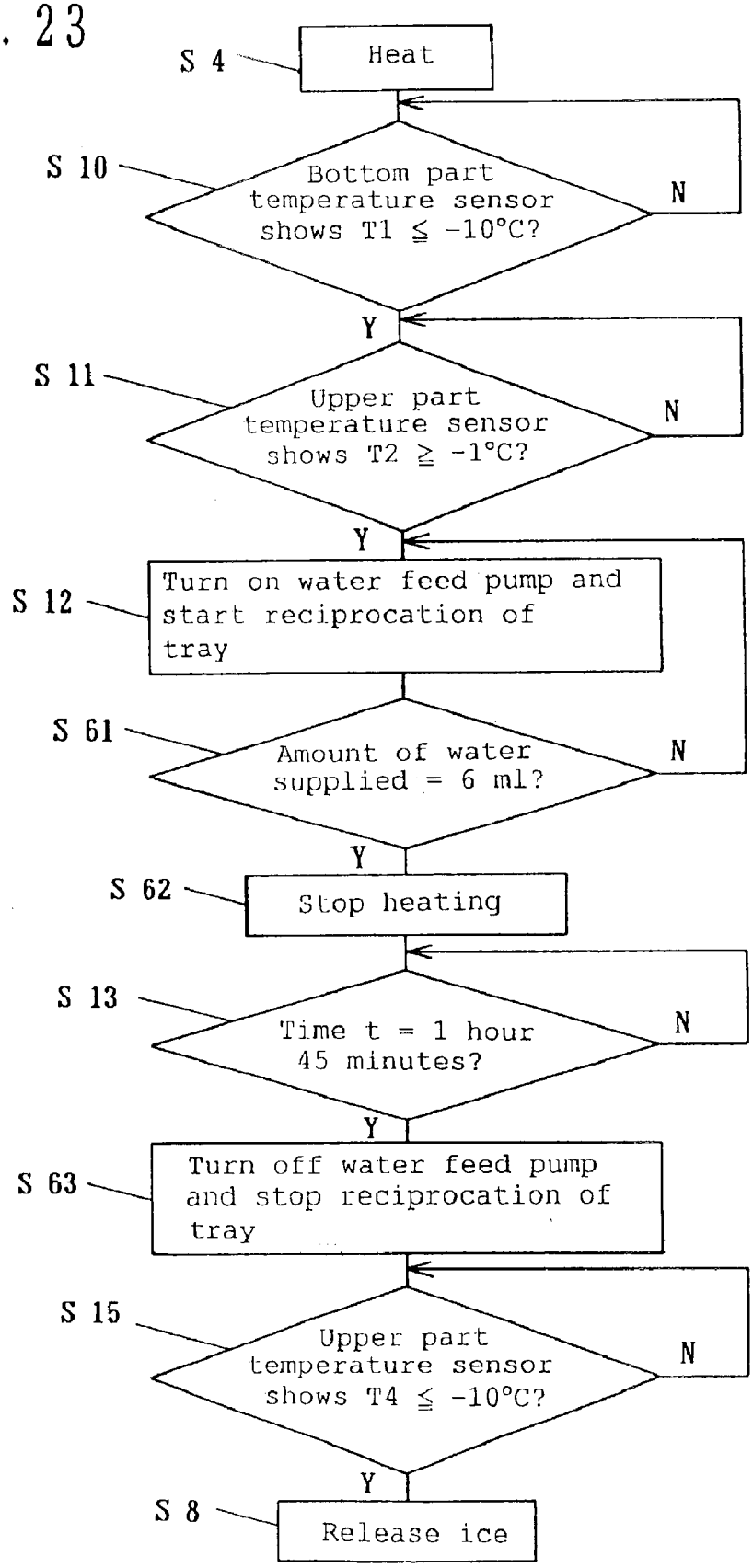
FIG. 23 is a flowchart of control according to an embodiment of the invention.

Now, an embodiment 9 will be described with reference to a control flowchart shown in FIG. 23. The determination of whether to start ice making based on the temperatures of the bottom part and the upper side face of the ice making tray 301, the operation of the water feed pump 311 and the reciprocation of the ice making tray are the same as in the embodiment 8, and the description thereof will be omitted. This embodiment 9 differs from the embodiment 8 in that, when the amount of supplied water reaches 6 ml, for example, heating by the heater wire 308 is stopped, and supply of water and reciprocation of the ice making tray continue until 1 hour and 45 minutes has elapsed since the start of supply of water, for example. Since the heating by the heater is stopped in the middle of ice making, the time required to make an ice can be reduced. The determination of whether ice making is completed is the same as in the embodiment 8. While it takes 2 hours to make an ice in the embodiment 8, ice making can be completed in 1 hour and 50 minutes in the embodiment 9. Thus, the time required for ice making can be reduced by 10 minutes. In this case,the resulting ice is highly transparent as a whole, though a little air bubbles may remain on the top surface of the ice.

(Embodiment 10)

Figure 24:
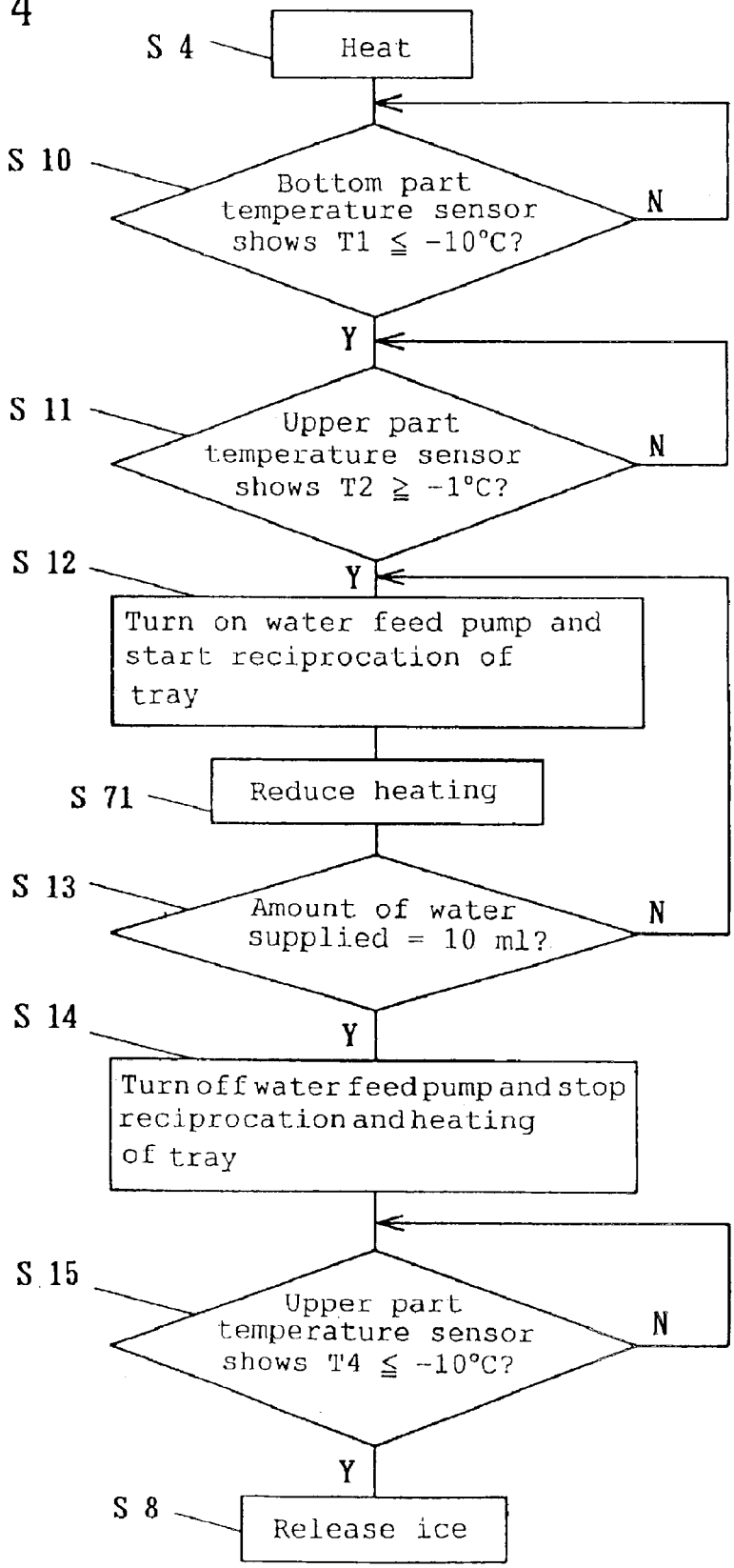
FIG. 24 is a flowchart of control according to an embodiment of the invention.
Figure 25:
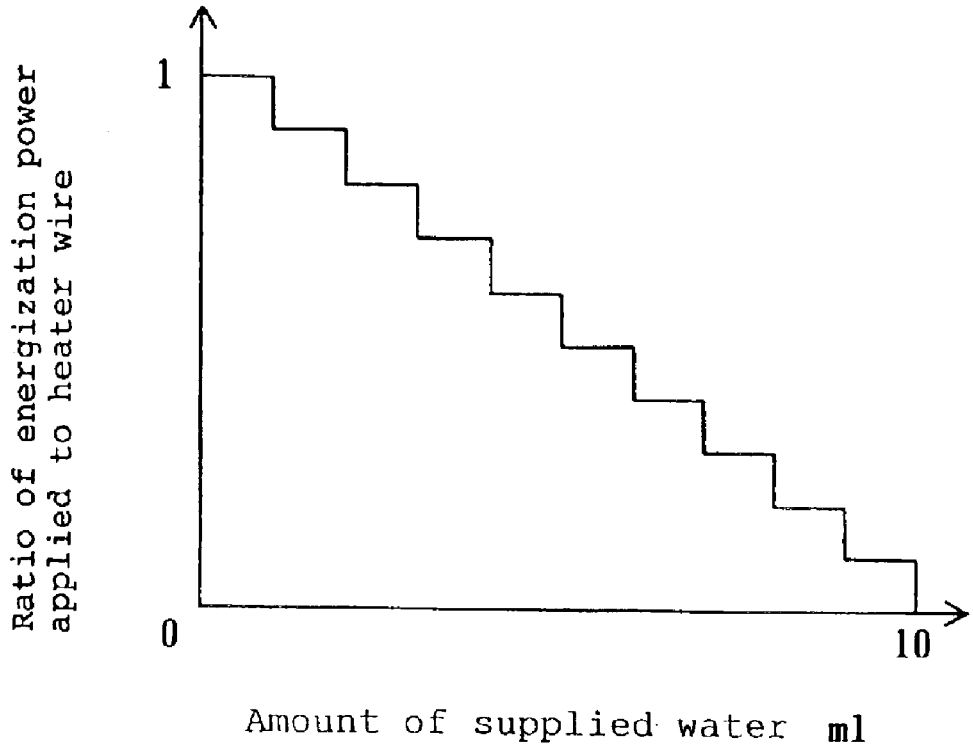
FIG. 25 is a graph showing a relationship between an amount of supplied water and an amount of electric power applied to a heater line according to an embodiment of the invention.

Now, an embodiment 10 will be described with reference to a control flowchart shown in FIG. 24. The determination of whether to start ice making based on the temperatures of the bottom part and the upper side face of the ice making tray 301, the operation of the water feed pump 311 and the reciprocation of the ice making tray 301 are the same as in the embodiment 8, and the description thereof will be omitted. This embodiment 10 differs from the embodiments 8 and 9 in that heating of the upper side face of the ice making tray 301 is controlled based on the amount of supplied water as shown in FIG. 25.

With reference to an energization power applied to the heater wire 308 when it is determined to start ice making, the energization power applied to the heater wire 308 is reduced by 10% thereof when the amount of supplied water reaches 1 ml, and is further reduced by 10% thereof when the amount of supplied water reaches 2 ml. If the total amount of water to be supplied is 10 ml, for example, heating is stopped when the amount reaches 10 ml, and at the same time, the operation of the water feed pump 311 and the reciprocation of the ice making tray are also stopped. Although the temperature of the upper side face of the ice making tray 301 is not necessarily kept constant, diffusion of the latent heat generated by heating by the heater is effectively attained without being suppressed, and thus, the time required to make an ice can be further reduced. While it takes 2 hours to make an ice in the embodiment 8, ice making can be completed in 1 hour and 40 minutes in the embodiment 9. Thus, the time required for ice making can be reduced by 20 minutes. In this case, the resulting ice is highly transparent as a whole, though extremely small air bubbles may remain in a small amount on the surface of the ice in contact with the ice making tray 301.

As described above, with the ice making apparatus according to the $22^{nd}$ aspect of this invention, an ice with an extremely highly transparency can be obtained though it takes 2 hours to make the ice.

In addition, with the ice making apparatus according to the $23^{rd}$ aspect of this invention, an ice can be made in 1 hour and 50 minutes, while it takes 2 hours to make the ice in the embodiment 7. Thus, the time required for ice making can be reduced by 10 minutes. In this case, the resulting ice is highly. transparent as a whole, though a little air bubbles may remain on the top surface of the ice.

In addition, with the ice making apparatus according to the $24^{th}$ aspect of this invention, an ice can be made in 1 hour and 40 minutes, while it takes 2 hours to make the ice in the embodiment 7. Thus, the time required for ice making can be reduced by 20 minutes. In this case, the resulting ice is highly transparent as a whole, though extremely small air bubbles may remain in a small amount on the surface of the ice in contact with the ice making tray 301. In this way, it is possible to make a clear ice in a quite short time. In addition, the control means that controls the temperature detecting means, the reciprocating means and the intermittent water supply means of the ice making tray enables an optimum condition to be determined in a short time and an ice with an extremely high transparency to be provided.

As can be apparent from the above description, the present invention provides a clear ice making apparatus and a clear ice making method that can make an ice with a high transparency.

According to this invention, a clear ice can be made in a relatively short time.

In addition, if the water feed nozzle is used, even if the apparatus is inclined, it causes no problem.

In addition, if the temperature variation at the bottom part of the ice making tray is detected, an optimum ice making condition can be provided, and thus, an ice with a transparency of 90% or higher can be constantly made.

In addition, if the ice making is conducted while degassing the supplied water, an air bubble, which is a primary factor that makes the resulting ice cloudy, is not generated at all, and an ice with an extremely high transparency can be made. And, even in a short time, an ice with a transparency of 90% or higher can be constantly made.

In addition, if the water required for ice making is divided and supplied plural times intermittently, the time required for ice making is reduced, compared to the case where the required amount of water is poured into the cell at a time.

What is claimed is:

1. A clear ice making apparatus having an ice making cycle defined as (a) supply water to a tray and (b) emptying the tray after water freezes in the tray, the apparatus comprising:

a freezing space;

a tray placed in said freezing space and having a lower temperature at a bottom part thereof than at an upper part thereof; and water supply means of supplying water intermittently during the ice making cycle to said tray from a top of said tray, wherein;

the lower temperature at the bottom part of the tray is controlled such that an ice is made at an ice making rate of 5 $\mu$m/s or lower, said water supply means supplies water intermittently to said tray so that a part of a liquid-phase section of water in said tray which part is in contact with atmosphere remains in a liquid phase until the ice making is completed, and the liquid-phase section of water in said tray has a thickness equal to or less than a predetermined thickness.

2. The clear ice making apparatus according to claim 1, wherein said predetermined thickness is a thickness that allows substantially no air bubble to be generated.

3. The clear ice making apparatus according to claim 1 or 2, wherein said ice making rate is equal to or higher than 2 $\mu$m/s.

4. The clear ice making apparatus according to claim 1, wherein said water supply means starts a following supply of water before a surface of the water having already been supplied is frozen and repeats such supply of water until the ice being made attains a predetermined thickness, and when the supply of water is stopped, the part of the liquid-phase section of water in said tray which part is in contact with atmosphere is lastly frozen.

5. The clear ice making apparatus according to claim 4, wherein the interval at which said water supply means supplies water is adapted to prevent the entire liquid-phase section of water in said tray from being supercooled.

6. The clear ice making apparatus according to any of claims 1, 2, and 4 wherein the temperature of a side surface of said tray is higher than that of the bottom surface thereof.

7. A clear ice making method of making a clear ice using a clear ice making apparatus, the clear ice making apparatus including a freezing space, a tray placed in said freezing space and having a lower temperature at a bottom part thereof than at an upper part thereof, and water supply means of supplying water intermittently to said tray, the method including the steps of:

a) controlling the lower temperature at the bottom part of the tray such that an ice is made at an ice making rate of 5 $\mu$m/s or lower, and b) supplying water intermittently from the water supplying means such that the water is supplied intermittently during an ice making cycle, wherein the ice making cycle is defined as (i) supplying water to the tray and (ii) emptying the tray after water freezes in the tray;

a part of a liquid-phase section of water in said tray which part is in contact with atmosphere remains in a liquid phase until the ice making is completed, and the liquid-phase section of water in said tray has a thickness equal to or less than a predetermined thickness.

* * * * *

UNITED STATES PATENT AND TRADEMARK OFFICE

CERTIFICATE OF CORRECTION

PATENT NO. : 6,935,124 B2
DATED : August 30, 2005
INVENTOR(S) : Yasuhito Takahashi et al.

It is certified that error appears in the above-identified patent and that said Letters Patent is hereby corrected as shown below:

Column 21,
Line 39, delete “supply” and insert -- supplying --.

Signed and Sealed this

Twenty-eighth Day of March, 2006

JON W. DUDAS
*Director of the United States Patent and Trademark Office*